US010354664B2

(12) United States Patent
Kaniewska et al.

(10) Patent No.: US 10,354,664 B2
(45) **Date of Patent: *Jul. 16, 2019**

(54) OPTIMIZED SCALE FACTOR FOR FREQUENCY BAND EXTENSION IN AN AUDIO FREQUENCY SIGNAL DECODER

(71) Applicant: KONINKLIJKE PHILIPS N.V., Eindhoven (NL)

(72) Inventors: Magdalena Kaniewska, Leuven (BE); Stephane Ragot, Lannion (FR)

(73) Assignee: KONINKLIKJKE PHILIPS N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/715,785

(22) Filed: Sep. 26, 2017

(65) Prior Publication Data

US 2018/0018983 A1 Jan. 18, 2018

Related U.S. Application Data

(62) Division of application No. 14/904,555, filed as application No. PCT/FR2014/051720 on Jul. 4, 2014.

(51) Int. Cl.
*G10L 19/00* (2013.01)
*G10L 21/00* (2013.01)
(Continued)

(52) U.S. Cl.
CPC ..... *G10L 19/087* (2013.01); *G10L 19/24* (2013.01); *G10L 21/038* (2013.01); *G10L 25/72* (2013.01)

(58) Field of Classification Search
CPC ..... G10L 19/0204; G10L 19/00; G10L 19/06; G10L 25/78; G10L 19/12; G10L 19/09; G10L 21/038; G10L 19/26; G10L 19/08
See application file for complete search history.

(56) References Cited

U.S. PATENT DOCUMENTS 5,414,796 A * 5/1995 Jacobs ..... G10L 19/005 704/201
7,283,967 B2 * 10/2007 Nishio ..... G10L 19/0208 704/205

(Continued)

FOREIGN PATENT DOCUMENTS

JP 2017145792 A 8/2017
WO 2011047578 A1 4/2011

OTHER PUBLICATIONS

Berisha et al,"Bandwidth extension of audio based on partial loudness criteria." Multimedia Signal Processing, 2006 IEEE 8th Workshop on. IEEE, 2006.*

(Continued)

*Primary Examiner* — Olujimi A Adesanya

(57) ABSTRACT

A method and device are provided for determining an optimized scale factor to be applied to an excitation signal or a filter during a process for frequency band extension of an audio frequency signal. The band extension process includes decoding or extracting, in a first frequency band, an excitation signal and parameters of the first frequency band including coefficients of a linear prediction filter, generating an excitation signal extending over at least one second frequency band, filtering using a linear prediction filter for the second frequency band. The determination method includes determining an additional linear prediction filter, of a lower order than that of the linear prediction filter of the first frequency band, the coefficients of the additional filter being obtained from the parameters decoded or extracted from the first frequency and calculating the optimized scale factor as a function of at least the coefficients of the additional filter.

14 Claims, 7 Drawing Sheets

(51) Int. Cl.

| | |
|---|---|
| ***G10L 21/04*** | (2013.01) |
| ***G10L 19/087*** | (2013.01) |
| ***G10L 19/24*** | (2013.01) |
| ***G10L 25/72*** | (2013.01) |
| ***G10L 21/038*** | (2013.01) |

(56) References Cited

U.S. PATENT DOCUMENTS

| | | | | |
|---|---|---|---|---|
| 8,121,832 | B2 | 2/2012 | Choo | |
| 8,260,609 | B2 | 9/2012 | Rajendran | |
| 8,392,198 | B1 * | 3/2013 | Berisha | G10L 19/0204 704/500 |
| 2007/0088542 | A1 | 4/2007 | Vos | |
| 2007/0147518 | A1 * | 6/2007 | Bessette | G10L 19/0212 375/243 |
| 2007/0225971 | A1 * | 9/2007 | Bessette | G10L 19/0208 704/203 |
| 2007/0282603 | A1 * | 12/2007 | Bessette | G10L 19/0208 704/219 |
| 2008/0294429 | A1 * | 11/2008 | Su | G10L 19/09 704/222 |
| 2009/0110208 | A1 | 4/2009 | Choo | |
| 2009/0201983 | A1 | 8/2009 | Jasiuk | |
| 2009/0326931 | A1 | 12/2009 | Ragot | |
| 2010/0070270 | A1 * | 3/2010 | Gao | G10H 1/0041 704/207 |
| 2010/0198587 | A1 | 8/2010 | Ramabadran | |
| 2011/0099004 | A1 | 4/2011 | Krishnan | |
| 2012/0010879 | A1 | 1/2012 | Tsujino | |
| 2014/0257827 | A1 | 9/2014 | Norvell | |
| 2014/0288925 | A1 * | 9/2014 | Sverrisson | G10L 21/038 704/206 |
| 2016/0196829 | A1 | 7/2016 | Liu | |
| 2017/0272459 | A1 | 9/2017 | Rusakov et al. | |
| 2017/0272853 | A1 | 9/2017 | Yang | |

OTHER PUBLICATIONS

3GPPTS26445, "EVS Codec Detailed Algorithmic Description", Nov. 2014, 3GPP Technical Specification (Release 12), 3GPP TS 26.445, pp. 1-13, 598, 603 of 626.*

Pulakka et al, "Bandwidth extension of telephone speech using a neural network and a filter bank implementation for highband mel spectrum", 2011, IEEE Transactions on Audio, Speech, and Language Processing, 19(7), 2170-2183.*

International Search Report, dated Aug. 28, 2014 for corresponding International Application No. PCT/FR2014/051720, filed Jul. 4, 2014.

English translation of the Written Opinion, dated Aug. 28, 2014 for corresponding International Application No. PCT/FR2014/051720, filed Jul. 4, 2014.

Geiser et al "Bandwidth Extension for Hierarchical Speech and Audio Coding in ITU-T Rec. G.729.1,", 2007, IEEE Transactions on Audio, Speech, and Language Processing, vol. 15, No. 8, pp. 2496-2509, Nov. 2007.

Krishnan et al, "EVRC-Wideband: The New 3GPP2 Wideband Vocoder Standard", 2007 IEEE International Conference on Acoustics, Speech and Signal Processing—ICASSP 2007, Honolulu, HI 2007, pp. II-333-II-336.

3GPPTS26445, "EVS Codec Detailed Algorithic Description", Nov. 2014, 3GPP Technical Specification (Release 12), 3GPP TS 26.445, pp. 1-13, 599, 601 and 602 of 626.

Bessette et al "The Adaptive Multriate Wideband Speech Codec (AMR-WB), ", 2002, in IEEE Transactions on Speech and Audio Processing, vol. 10, No. 8, pp. 620-636, Nov. 2002.

Jax et al "An Embedded Scalable Wideband Codec Based on teh GSM EFR Codec", 2006 IEEE International Conference on Acoustics, Speech and Signal Processing, Toulouse, 2006, pp. 1-1.

Freudenberger, "Bandwidth Extension for Mixed Asynchronous Asynchronous Synchronous Speech Transmission", 2009, Proceedings of the 8th WSEAS International Conference on Signal Processing, Robotics and Automation, pp. 304-308, World Scientific and Engineering Academy and Society (WSEAS).

Digital cellular telecommunications system (Phase 2+); Universal Mobile Telecommunications System (UMTS); LTE; Audio codec processing functions; Extended Adaptive Multi-Rate—Wideband (AMR-WB+) codec; Transcoding functions (3GPP TS 26.290 version 11.0.0 Release 11). 2012.

* cited by examiner

BFI_GAIN
decod. gain (dB)
201
gain interpol/ subf.
202
dB → linear
209
gain (dB) Fs/4 Hz
203
HF LP decod. interp.
204
bfi_isf_hf
HF ISF parameters
LF excit.
post.
206
smooth
208
HF
205
207
HF 210
211
212
213
64 samples
64 samples

OPTIMIZED SCALE FACTOR FOR FREQUENCY BAND EXTENSION IN AN AUDIO FREQUENCY SIGNAL DECODER

CROSS-REFERENCE TO RELATED APPLICATIONS

This application is a Divisional application of Ser. No. 14/904,555, filed Jan. 12, 2016, which is a U.S. National Phase application under 35 U.S.C. § 371 of International Application No. PCT/FR2014/051720, filed Jul. 4, 2014, which claims priority to French application no. 1356909, filed Jul. 12, 2013, the content of which is incorporated herein by reference in its entirety.

The present invention relates to the field of the coding/decoding and the processing of audio frequency signals (such as speech, music or other such signals) for their transmission or their storage.

More particularly, the invention relates to a method and a device for determining an optimized scale factor that can be used to adjust the level of an excitation signal or, in an equivalent manner, of a filter as part of a frequency band extension in a decoder or a processor enhancing an audio frequency signal.

Numerous techniques exist for compressing (with loss) an audio frequency signal such as speech or music.

The conventional coding methods for the conversational applications are generally classified as waveform coding (PCM for "Pulse Code Modulation", ADCPM for "Adaptive Differential Pulse Code Modulation", transform coding, etc.), parametric coding (LPC for "Linear Predictive Coding", sinusoidal coding, etc.) and parametric hybrid coding with a quantization of the parameters by "analysis by synthesis" of which CELP ("Code Excited Linear Prediction") coding is the best known example.

For the non-conversational applications, the prior art for (mono) audio signal coding consists of perceptual coding by transform or in subbands, with a parametric coding of the high frequencies by band replication.

A review of the conventional speech and audio coding methods can be found in the works by W. B. Kleijn and K. K. Paliwal (eds.), Speech Coding and Synthesis, Elsevier, 1995; M. Bosi, R. E. Goldberg, Introduction to Digital Audio Coding and Standards, Springer 2002; J. Benesty, M. M. Sondhi, Y. Huang (Eds.), Handbook of Speech Processing, Springer 2008.

The focus here is more particularly on the 3GPP standardized AMR-WB ("Adaptive Multi-Rate Wideband") codec (coder and decoder), which operates at an input/output frequency of 16 kHz and in which the signal is divided into two subbands, the low band (0-6.4 kHz) which is sampled at 12.8 kHz and coded by CELP model and the high band (6.4-7 kHz) which is reconstructed parametrically by "band extension" (or BWE, for "Bandwidth Extension") with or without additional information depending on the mode of the current frame. It can be noted here that the limitation of the coded band of the AMR-WB codec at 7 kHz is essentially linked to the fact that the frequency response in transmission of the wideband terminals was approximated at the 3.0 time of standardization (ETSI/3GPP then ITU-T) according to the frequency mask defined in the standard ITU-T P.341 and more specifically by using a so-called "P341" filter defined in the standard ITU-T G.191 which cuts the frequencies above 7 kHz (this filter observes the mask defined in P.341). However, in theory, it is well known that a signal sampled at 16 kHz can have a defined audio band from 0 to 8000 Hz; the AMR-WB codec therefore introduces a limitation of the high band by comparison with the theoretical bandwidth of 8 kHz.

The 3GPP AMR-WB speech codec was standardized in 2001 mainly for the circuit mode (CS) telephony applications on GSM (2G) and UMTS (3G). This same codec was also standardized in 2003 by the ITU-T in the form of recommendation G.722.2 "Wideband coding speech at around 16 kbit/s using Adaptive Multi-Rate Wideband (AMR-WB)".

It comprises nine bit rates, called modes, from 6.6 to 23.85 kbit/s, and comprises continuous transmission mechanisms (DTX, for "Discontinuous Transmission") with voice activity detection (VAD) and comfort noise generation (CNG) from silence description frames (SID, for "Silence Insertion Descriptor"), and lost frame correction mechanisms (FEC for "Frame Erasure Concealment", sometimes called PLC, for "Packet Loss Concealment").

The details of the AMR-WB coding and decoding algorithm are not repeated here; a detailed description of this codec can be found in the 3GPP specifications (TS 26.190, 26.191, 26.192, 26.193, 26.194, 26.204) and in ITU-T-G.722.2 (and the corresponding annexes and appendix) and in the article by B. Bessette et al. entitled "The adaptive multirate wideband speech codec (AMR-WB)", IEEE Transactions on Speech and Audio Processing, vol. 10, no. 8, 2002, pp. 620-636 and the source code of the associated 3GPP and ITU-T standards.

The principle of band extension in the AMR-WB codec is fairly rudimentary. Indeed, the high band (6.4-7 kHz) is generated by shaping a white noise through a time (applied in the form of gains per subframe) and frequency (by the application of a linear prediction synthesis filter or LPC, for "Linear Predictive Coding") envelope. This band extension technique is illustrated in FIG. 1.

A white noise $u_{HB1}(n)$, n=0, . . . , 79 is generated at 16 kHz for each 5 ms subframe by linear congruential generator (block 100). This noise $u_{HB1}(n)$ is formatted in time by application of gains for each subframe; this operation is broken down into two processing steps (blocks 102, 106 or 109):

A first factor is computed (block 101) to set the white noise $u_{HB1}(n)$ (block 102) at a level similar to that of the excitation, u(n), n=0, . . . , 63, decoded at 12.8 kHz in the low band:

$$u_{HB2}(n) = u_{HB1}(n)\sqrt{\frac{\sum_{l=0}^{63} u(l)^2}{\sum_{l=0}^{79} u_{HB1}(l)^2}}$$

It can be noted here that the normalization of the energies is done by comparing blocks of different size (64 for u(n) and 80 for $u_{HB1}(n)$) without compensation of the differences in sampling frequencies (12.8 or 16 kHz).

The excitation in the high band is then obtained (block 106 or 109) in the form:

$$u_{HB}(n)=\hat{g}_{HB}u_{HB2}(n)$$

in which the gain $\hat{g}_{HB}$ is obtained differently depending on the bit rate. If the bit rate of the current frame is <23.85 kbit/s, the gain $\hat{g}_{HB}$ is estimated "blind" (that is to say without additional information); in this case, the block 103 filters the signal decoded in low band by a high-pass filter having a cut-off frequency at 400 Hz to obtain a signal $\hat{s}_{hp}(n)$, n=0, . . . 63—this high-pass filter eliminates the influence of the very low frequencies which can skew the estimation made in the block 104—then the "tilt" (indicator of spectral slope) denoted $e_{tilt}$ of the signal $\hat{s}_{hp}(n)$ is computed by normalized self-correlation (block 104):

$$e_{tilt} = \frac{\sum_{n=1}^{63} \hat{s}_{hp}(n)\hat{s}_{hp}(n-1)}{\sum_{n=0}^{63} \hat{s}_{hp}(n)^2}$$

and finally, $\hat{g}_{HB}$ is computed in the form:

$$\hat{g}_{HB}=w_{SP}g_{SP}+(1-w_{SP})g_{BG}$$

in which $g_{SP}=1-e_{tilt}$ is the gain applied in the active speech (SP) frames, $g_{BG}=1.25g_{SP}$ is the gain applied in the inactive speech frames associated with a background (BG) noise and $w_{SP}$ is a weighting function which depends on the voice activity detection (VAD). It is understood that the estimation of the tilt ($e_{tilt}$) makes it possible to adapt the level of the high band as a function of the spectral nature of the signal; this estimation is particularly important when the spectral slope of the CELP decoded signal is such that the average energy decreases when the frequency increases (case of a voiced signal where $e_{tilt}$ is close to 1, therefore $g_{SP}=1-e_{tilt}$ is thus reduced). It should also be noted that the factor $\hat{g}_{HB}$ in the AMR-WB decoding is bounded to take values within the range [0.1, 1.0]. Indeed, for the signals whose energy increases when the frequency increases ($e_{tilt}$ close to −1, $g_{SP}$ close to 2), the gain $\hat{g}_{HB}$ is usually underestimated.

At 23.85 kbit/s, a correction information item is transmitted by the AMR-WB coder and decoded (blocks 107, 108) in order to refine the gain estimated for each subframe (4 bits every 5 ms, or 0.8 kbit/s). The artificial excitation $u_{HB}(n)$ is then filtered (block 111) by an LPC synthesis filter (block 111) of transfer function $1/A_{HB}(z)$ and operating at the sampling frequency of 16 kHz. The construction of this filter depends on the bit rate of the current frame:

At 6.6 kbit/s, the filter $1/A_{HB}(z)$ is obtained by weighting by a factor $\gamma=0.9$ an LPC filter of order 20, $1/\hat{A}^{ext}(z)$, which "extrapolates" the LPC filter of order 16, $1/\hat{A}(z)$, decoded in the low band (at 12.8 kHz)—the details of the extrapolation in the realm of the ISF (Imittance Spectral Frequency) parameters are described in the standard G.722.2 in section 6.3.2.1; in this case, $$1/A_{HB}(z)=1/\hat{A}^{ext}(z/\gamma)$$

at the bit rates >6.6 kbit/s, the filter $1/A_{HB}(z)$ is of order 16 and corresponds simply to:

$$1/A_{HB}(z)=1/\hat{A}(z/\gamma)$$

in which $\gamma=0.6$. It should be noted that, in this case, the filter $1/\hat{A}(z/\gamma)$ is used at 16 kHz, which results in a spreading (by proportional transformation) of the frequency response of this filter from [0, 6.4 kHz] to [0, 8 kHz].

The result, $s_{HB}(n)$, is finally processed by a bandpass filter (block 112) of FIR ("Finite Impulse Response") type, to keep only the 6-7 kHz band; at 23.85 kbit/s, a low-pass filter also of FIR type (block 113) is added to the processing to further attenuate the frequencies above 7 kHz. The high frequency (HF) synthesis is finally added (block 130) to the low frequency (LF) synthesis obtained with the blocks 120 to 122 and resampled at 16 kHz (block 123). Thus, even if the high band extends in theory from 6.4 to 7 kHz in the AMR-WB codec, the HF synthesis is rather contained in the 6-7 kHz 3.5 band before addition with the LF synthesis.

A number of drawbacks in the band extension technique of the AMR-WB codec can be identified, in particular:

the estimation of gains for each subframe (block 101, 103 to 105) is not optimal. Partly, it is based on an equalization of the "absolute" energy per subframe (block 101) between signals at different frequencies: artificial excitation at 16 kHz (white noise) and a signal at 12.8 kHz (decoded ACELP excitation). It can be noted in particular that this approach implicitly induces an attenuation of the high-band excitation (by a ratio 12.8/16=0.8); in fact, it will also be noted no de-emphasis is performed on the high band in the AMR-WB codec, which implicitly induces an amplification relatively close to 0.6 (which corresponds to the value of the frequency response of $1/(1-0.68\ z^{-1}$ at 6400 Hz). In fact, the factors of 1/0.8 and of 0.6 are compensated approximately.

Regarding speech, the 3GPP AMR-WB codec characterization tests documented in the 3GPP report TR 26.976 have shown that the mode at 23.85 kbit/s has a less good quality than at 23.05 kbit/s, its quality being in fact similar to that of the mode at 15.85 kbit/s. This shows in particular that the level of artificial HF signal has to be controlled very prudently, because the quality is degraded at 23.85 kbit/s whereas the 4 bits per frame are considered to best make it possible to approximate the energy of the original high frequencies.

The low-pass filter at 7 kHz (block 113) introduces a shift of almost 1 ms between the low and high bands, which can potentially degrade the quality of certain signals by slightly desynchronizing the two bands at 23.85 kbit/s—this desynchronization can also pose problems when switching bit rate from 23.85 kbit/s to other modes.

An example of band extension via a temporal approach is described in the 3GPP standard TS 26.290 describing the AMR-WB+ codec (standardized in 2005). This example is illustrated in the block diagrams of FIGS. 2*a* (general block diagram) and 2*b* (gain prediction by response level correction) which correspond respectively to FIGS. 16 and 10 of the 3GPP specification TS 26.290.

In the AMR-WB+ codec, the (mono) input signal sampled at the frequency Fs (in Hz) is divided into two separate frequency bands, in which two LPC filters are computed and coded separately:

one LPC filter, denoted A(z), in the low band (0-Fs/4)—its quantized version is denoted $\hat{A}(z)$ another LPC filter, denoted $A_{HF}(z)$, in the spectrally aliased high band (Fs/4-Fs/2) its quantized version is denoted $\hat{A}_{HF}(z)$ The band extension is done in the AMR-WB+ codec as detailed in sections 5.4 (HF coding) and 6.2 (HF decoding) of the 3GPP specification TS 26.290. The principle thereof is summarized here: the extension consists in using the excitation decoded at low frequencies (LFC excit.) and in formatting this excitation by a temporal gain per subframe (block 205) and an LPC synthesis filtering (block 207); the processing operations to enhance (post-processing) the excitation (block 206) and smooth the energy of the reconstructed HF signal (block 208) are moreover implemented as illustrated in FIG. 2*a*.

It is important to note that this extension in AMR-WB+ necessitates the transmission of additional information: the coefficients of the filter $\hat{A}_{HF}(z)$ in 204 and a temporal formatting gain per subframe (block 201). One particular feature of the band extension algorithm in AMR-WB+ is that the gain per subframe is quantified by a predictive approach; in other words, the gains are not coded directly, but rather gain corrections which are relative to an estimation of the gain denoted $g_{match}$. This estimation, $g_{match}$, actually corresponds to a level equalization factor between the filters $\hat{A}(z)$ and $\hat{A}_{HF}(z)$ at the frequency of separation between low band and high band (Fs/4). The computation of the factor $g_{match}$ (block 203) is detailed in FIG. 10 of the 3GPP specification TS 26.290 reproduced here in FIG. 2*b*. This figure will not be detailed more here. It will simply be noted that the blocks 210 to 213 are used to compute the energy of the impulse response of $$\frac{\hat{A}(z)}{(1-0.9z^{-1})\hat{A}_{HF}(z)},$$

while recalling that the filter $\hat{A}_{HF}$ (z) models a spectrally aliased high band (because of the spectral properties of the filter bank separating the low and high bands). Since the filters are interpolated by subframes, the gain $g_{match}$ is computed only once per frame, and it is interpolated by subframes. The band extension gain coding technique in AMR-WB+, and more particularly the compensation of levels of the LPC filters at their junction is an appropriate method in the context of a band extension by LPC models in low and high band, and it can be noted that such a level compensation between LPC filters is not present in the band extension of the AMR-WB codec. However, it is in practice possible to verify that the direct equalization of the level between the two LPC filters at the separation frequency is not an optimal method and can provoke an overestimation of energy in high band and audible artifacts in certain cases; it will be recalled that an LPC filter represents a spectral envelope, and the principle of equalization of the level between two LPC filters for a given frequency amounts to adjusting the relative level of two LPC envelopes. Now, such an equalization performed at a precise frequency does not ensure a complete continuity and overall consistency of the energy (in frequency) in the vicinity of the equalization point when the frequency envelope of the signal fluctuates significantly in this vicinity. A mathematical way of positing the problem consists in noting that the continuity between two curves can be ensured by forcing them to meet at one and the same point, but there is nothing to guarantee that the local properties (successive derivatives) coincide so as to ensure a more global consistency. The risk in ensuring a spot continuity between low and high band LPC envelopes is of setting the LPC envelope in high band at a relative level that is too strong or too weak, the case of a level that is too strong being more damaging because it results in more annoying artifacts.

Moreover, the gain compensation in AMR-WB+ is primarily a prediction of the gain known to the coder and to the decoder and which serves to reduce the bit rate necessary for the transmission of gain information scaling the high-band excitation signal. Now, in the context of an interoperable enhancement of the AMR-WB coding/decoding, it is not possible to modify the existing coding of the gains by subframes (0.8 kbit/s) of the band extension in the AMR-WB 23.85 kbit/s mode. Furthermore, for the bit rates strictly less than 23.85 kbit/s, the compensation of levels of LPC filters in low and high bands can be applied in the band extension of a decoding compatible with AMR-WB, but experience shows that this sole technique derived from the AMR-WB+ coding, applied without optimization, can cause problems of overestimation of energy of the high band (>6 kHz).

There is therefore a need to improve the compensation of gains between linear prediction filters of different frequency bands for the frequency band extension in a codec of AMR-WB type or an interoperable version of this codec without in any way overestimating the energy in a frequency band and without requiring additional information from the coder.

The present invention improves the situation.

To this end, the invention targets a method for determining an optimized scale factor to be applied to an excitation signal or to a filter in an audio frequency signal frequency band extension method, the band extension method comprising a step of decoding or of extraction, in a first frequency band, of an excitation signal and of parameters of the first frequency band comprising coefficients of a linear prediction filter, a step of generation of an extended excitation signal on at least one second frequency band and a step of filtering, by a linear prediction filter, for the second frequency band. The determination method is such that it comprises the following steps:

- determination of a linear prediction filter called additional filter, of lower order than the linear prediction filter of the first frequency band, the coefficients of the additional filter being obtained from the parameters decoded or extracted from the first frequency band; and
- computation of the optimized scale factor as a function at least of the coefficients of the additional filter.

Thus, the use of an additional filter of lower order than the filter of the first frequency band to be equalized makes it possible to avoid the overestimations of energy in the high frequencies which could result from local fluctuations of the envelope and which can disrupt the equalization of the prediction filters.

The equalization of gains between the linear prediction filters of the first and second frequency bands is thus enhanced.

In an advantageous application of the duly obtained optimized scale factor, the band extension method comprises a step of application of the optimized scale factor to the extended excitation signal.

In an appropriate embodiment, the application of the optimized scale factor is combined with the step of filtering in the second frequency band.

Thus, the steps of filtering and of application of the optimized scale factor are combined in a single filtering step to reduce the processing complexity.

In a particular embodiment, the coefficients of the additional filter are obtained by truncation of the transfer function of the linear prediction filter of the first frequency band to obtain a lower order.

This lower order additional filter is therefore obtained in a simple manner.

Furthermore, so as to obtain a stable filter, the coefficients of the additional filter are modified as a function of a stability criterion of the additional filter.

In a particular embodiment, the computation of the optimized scale factor comprises the following steps:

- computation of the frequency responses of the linear prediction filters of the first and second frequency bands for a common frequency;
- computation of the frequency response of the additional filter for this common frequency;

computation of the optimized scale factor as a function of the duly computed frequency responses.

Thus, the optimized scale factor is computed in such a way as to avoid the annoying artifacts which could occur should the higher order filter frequency response of the first band in proximity to the common frequency show a signal peak or trough.

In a particular embodiment, the method further comprises the following steps, implemented for a predetermined decoding bit rate:

- first scaling of the extended excitation signal by a gain computed per subframe as a function of an energy ratio between the decoded excitation signal and the extended excitation signal;
- second scaling of the excitation signal obtained from the first scaling by a decoded correction gain;
- adjustment of the energy of the excitation for the current subframe by an adjustment factor computed as a function of the energy of the signal obtained after the second scaling and as a function of the signal obtained after application of the optimized scale factor.

Thus, additional information can be used to enhance the quality of the extended signal for a predetermined operating mode.

The invention also targets a device for determining an optimized scale factor to be applied to an excitation signal or to a filter in an audio frequency signal frequency band extension device, the band extension device comprising a module for decoding or extracting, in a first frequency band, an excitation signal and parameters of the first frequency band comprising coefficients of a linear prediction filter, a module for generating an extended excitation signal on at least one second frequency band and a module for filtering, by a linear prediction filter, for the second frequency band. The determination device is such that it comprises:

- a module for determining a linear prediction filter called additional filter, of lower order than the linear prediction filter of the first frequency band, the coefficients of the additional filter being obtained from the parameters decoded or extracted from the first frequency band; and
- a module for computing the optimized scale factor as a function at least of the coefficients of the additional filter.

The invention targets a decoder comprising a device as described.

It targets a computer program comprising code instructions for implementing the steps of the method for determining an optimized scale factor as described, when these instructions are executed by a processor.

Finally, the invention relates to a storage medium, that can be read by a processor, incorporated or not in the device for determining an optimized scale factor, possibly removable, storing a computer program implementing a method for determining an optimized scale factor as described previously.

Other features and advantages of the invention will become more clearly apparent on reading the following description, given purely as a nonlimiting example and with reference to the attached drawings, in which:

FIG. 1 illustrates a part of a decoder of AMR-WB type implementing frequency band extension steps of the prior art and as described previously;

FIGS. 2*a* and 2*b* present the coding of the high band in the AMR-WB+ codec according to the prior art and as described previously;

FIG. 3 illustrates an exemplary decoder, compatible with the AMR-WB/G.722.2 standard in which there is a band extension comprising a determination of an optimized scale factor according to an embodiment of the method of the invention, implemented by the band extension device illustrated by the block 309.

Unlike the AMR-WB decoding which operates with an output sampling frequency of 16 kHz, a decoder is considered here which can operate with an output signal (synthesis) at the frequency fs=8, 16, 32 or 48 kHz. It should be noted that it is assumed here that the coding has been performed according to the AMR-WB algorithm with an internal frequency of 12.8 kHz for the CELP coding in low band and at 23.85 kbit/s a gain coding per subframe at the frequency of 16 kHz; even though the invention is described here at the decoding level, it is assumed here that the coding can also operate with an input signal at the frequency fs=8, 16, 32 or 48 kHz and suitable resampling operations, beyond the context of the invention, are implemented in coding as a function of the value offs. It can be noted that, when fs=8 kHz, in the case of a decoding compatible with AMR-WB, it is not necessary to extend the 0-6.4 kHz low band, because the audio band reconstructed at the frequency fs is limited to 0-4000 Hz.

Figure 3:
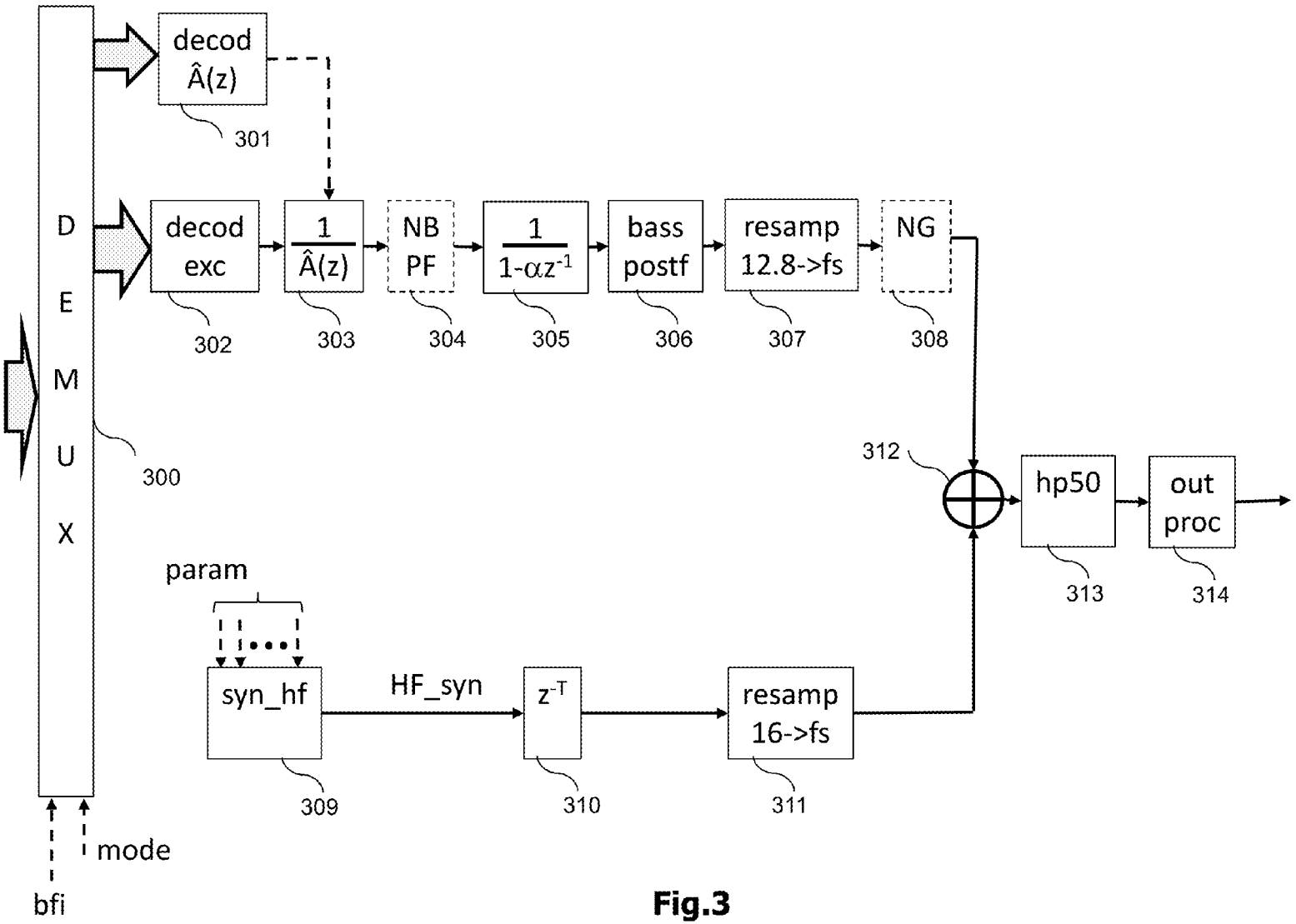
FIG. 3 illustrates a decoder that can interwork with the AMR-WB coding, incorporating a band extension device used according to an embodiment of the invention.

In FIG. 3, the CELP decoding (LF for low frequencies) still operates at the internal frequency of 12.8 kHz, as in AMR-WB, and the band extension (HF for high frequencies) used for the invention operates at the frequency of 16 kHz, and the LF and HF syntheses are combined (block 312) at the frequency fs after suitable resampling (block 306 and internal processing in the block 311). In the variant embodiments, the combining of the low and high bands can be done at 16 kHz, after having resampled the low band from 12.8 to 16 kHz, before resampling the combined signal at the frequency fs.

The decoding according to FIG. 3 depends on the AMR-WB mode (or bit rate) associated with the current frame received. As an indication, and without affecting the block 309, the decoding of the CELP part in low band comprises the following steps:

- demultiplexing of the coded parameters (block 300) in the case of a frame correctly received (bfi=0 where bfi is the "bad frame indicator" with a value 0 for a frame received and 1 for a frame lost);
- decoding of the ISF parameters with interpolation and conversion into LPC coefficients (block 301) as described in clause 6.1 of the standard G.722.2;

decoding of the CELP excitation (block 302), with an adaptive and fixed part for reconstructing the excitation (exc or u'(n)) in each subframe of length 64 at 12.8 kHz:

$$u'(n)=\hat{g}_p v(n)+\hat{g}_c c(n),\ n=0,\ldots,63$$

by following the notations of clause 7.1.2.1 of ITU-T recommendation G.718 of a decoder interoperable with the AMR-WB coder/decoder, concerning the CELP decoding, where v(n) and c(n) are respectively the code words of the adaptive and fixed dictionaries, and $\hat{g}_p$ and $\hat{g}_c$ are the associated decoded gains. This excitation u'(n) is used in the adaptive dictionary of the next subframe; it is then post-processed and, as in G.718, the excitation u'(n) (also denoted exc) is distinguished from its modified post-processed version u(n) (also denoted exc2) which serves as input for the synthesis filter, $1/\hat{A}(z)$, in the block 303;

synthesis filtering by $1/\hat{A}(z)$ (block 303) where the decoded LPC filter $\hat{A}(z)$ is of the order 16;

narrow-band post-processing (block 304) according to clause 7.3 of G.718 if fs=8 kHz;

de-emphasis (block 305) by the filter $1/(1-0.68\ z^{-1})$;

post-processing of the low frequencies (called "bass pos-filter") (block 306) attenuating the cross-harmonics noise at low frequencies as described in clause 7.14.1.1 of G.718. This processing introduces a delay which is taken into account in the decoding of the high band (>6.4 kHz);

resampling of the internal frequency of 12.8 kHz at the output frequency fs (block 307). A number of embodiments are possible. Without losing generality, it is considered here, by way of example, that if fs=8 or 16 kHz, the resampling described in clause 7.6 of G.718 is repeated here, and if fs=32 or 48 kHz, additional finite impulse response (FIR) filters are used;

computation of the parameters of the "noise gate" (block 308) preferentially performed as described in clause 7.14.3 of G.718 to "enhance" the quality of the silences by level reduction.

In variants which can be implemented for the invention, the post-processing operations applied to the excitation can be modified (for example, the phase dispersion can be enhanced) or these post-processing operations can be extended (for example, a reduction of the cross-harmonics noise can be implemented), without affecting the nature of the band extension.

It can be noted that the use of blocks 306, 308, 314 is optional.

It will also be noted that the decoding of the low band described above assumes a so-called "active" current frame with a bit rate between 6.6 and 23.85 kbit/s. In fact, when the DTX mode is activated, certain frames can be coded as "inactive" and in this case it is possible to either transmit a silence descriptor (on 35 bits) or transmit nothing. In particular, it will be recalled that the SID frame describes a number of parameters: ISF parameters averaged over 8 frames, average energy over 8 frames, "dithering" flag for the reconstruction of non-stationary noise. In all cases, in the decoder, there is the same decoding model as for an active frame, with a reconstruction of the excitation and of an LPC filter for the current frame, which makes it possible to apply the band extension even to inactive frames. The same observation applies for the decoding of "lost frames" (or FEC, PLC) in which the LPC model is applied.

Figure 7:
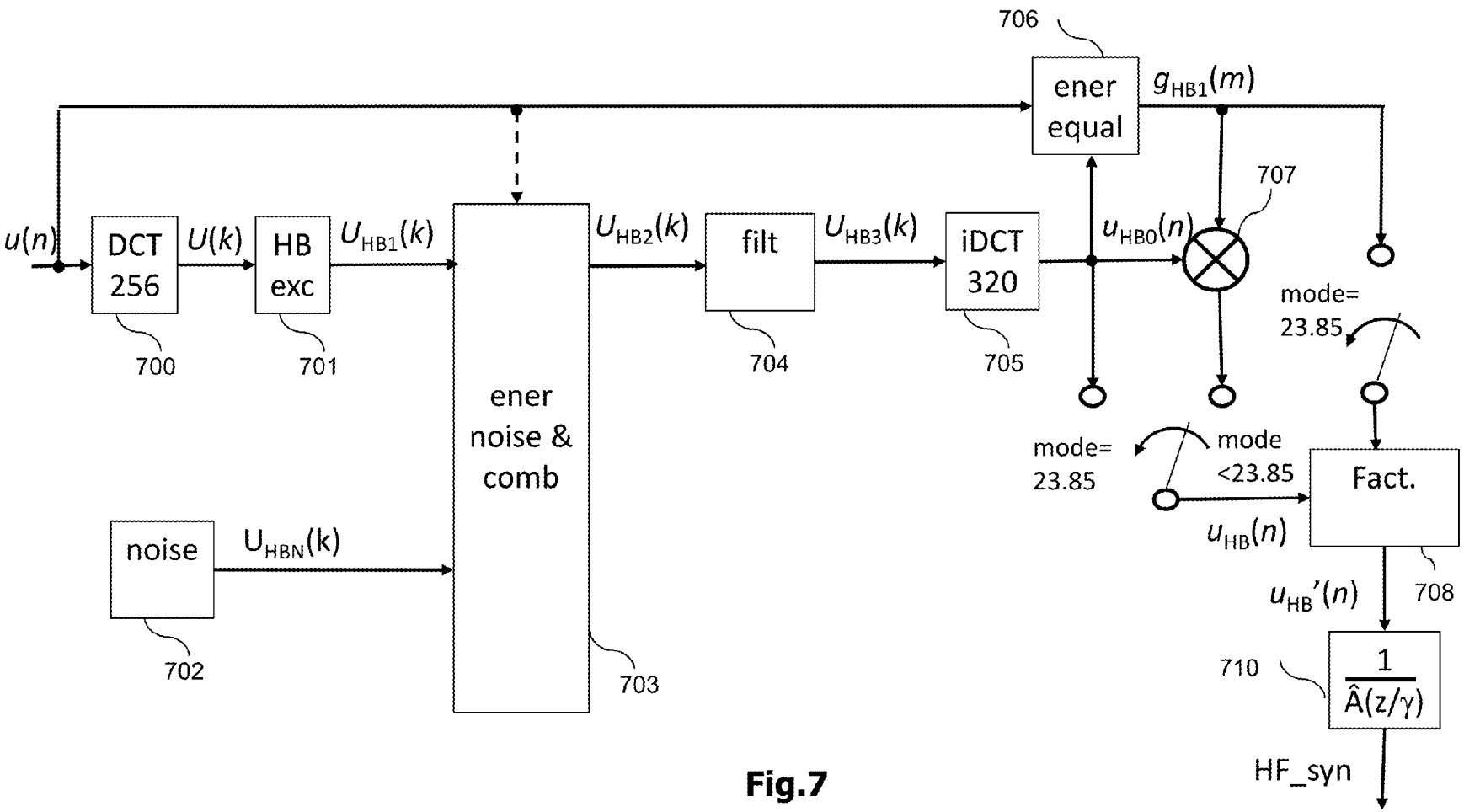
FIG. 7 illustrates an embodiment in the frequency domain of a device for determining an optimized scale factor as part of a band extension.

In the embodiment described here and with reference to FIG. 7, the decoder makes it possible to extend the decoded low band (50-6400 Hz taking into account the 50 Hz high-pass filtering on the decoder, 0-6400 Hz in the general case) to an extended band, the width of which varies, ranging approximately from 50-6900 Hz to 50-7700 Hz depending on the mode implemented in the current frame. It is thus possible to refer to a first frequency band of 0 to 6400 Hz and to a second frequency band of 6400 to 8000 Hz. In reality, in the preferred embodiment, the extension of the excitation is performed in the frequency domain in a 5000 to 8000 Hz band, to allow a bandpass filtering of 6000 to 6900 or 7700 Hz width.

At 23.85 kbit/s, the HF gain correction information (0.8 kbit/s) transmitted at 23.85 kbit/s is here decoded. Its use is detailed later, with reference to FIG. 4. The high-band synthesis part is produced in the block 309 representing the band extension device used for the invention and which is detailed in FIG. 7 in an embodiment.

In order to align the decoded low and high bands, a delay (block 310) is introduced to synchronize the outputs of the blocks 306 and 307 and the high band synthesized at 16 kHz is resampled from 16 kHz to the frequency fs (output of block 311). The value of the delay T depends on how the high band signal is synthesized, and on the frequency fs as in the post-processing of the low frequencies. Thus, generally, the value of T in the block 310 will have to be adjusted according to the specific implementation.

The low and high bands are then combined (added) in the block 312 and the synthesis obtained is post-processed by 50 Hz high-pass filtering (of IIR type) of order 2, the coefficients of which depend on the frequency fs (block 313) and output post-processing with optional application of the "noise gate" in a manner similar to G.718 (block 314).

Referring to FIG. 3, an embodiment of a device for determining an optimized scale factor to be applied to an excitation signal in a frequency band extension process is now described. This device is included in the band extension block 309 described previously.

Thus, the block 400, from an excitation signal decoded in a first frequency band u(n), performs a band extension to obtain an extended excitation signal $u_{HB}(n)$ on at least one second frequency band.

It will be noted here that the optimized scale factor estimation according to the invention is independent of how the signal $u_{HB}(n)$ is obtained. One condition concerning its energy is, however, important. Indeed, the energy of the high band from 6000 to 8000 Hz must be at a level similar to the energy of the band from 4000 to 6000 Hz of the decoded excitation signal at the output of the block 302. Furthermore, since the low-band signal is de-emphasized (block 305), the de-emphasis must also be applied to the high-band excitation signal, either by using a specific de-emphasis filter, or by multiplying by a constant factor which corresponds to an average attenuation of the filter mentioned. This condition does not apply to the case of the 23.85 kbit/s bit rate which uses the additional information transmitted by the coder. In this case, the energy of the high-band excitation signal must be consistent with the energy of the signal corresponding to the coder, as explained later.

The frequency band extension can, for example, be implemented in the same way as for the decoder of AMR-WB type described with reference to FIG. 1 in the blocks 100 to 102, from a white noise.

In another embodiment, this band extension can be performed from a combination of a white noise and of a decoded excitation signal as illustrated and described later for the blocks 700 to 707 in FIG. 7.

Other frequency band extension methods with conservation of the energy level between the decoded excitation signal and the extended excitation signal as described below, can of course be envisaged for the block 400.

Furthermore, the band extension module can also be independent of the decoder and can perform a band extension for an existing audio signal stored or transmitted to the extension module, with an analysis of the audio signal to extract an excitation and an LPC filter therefrom. In this case, the excitation signal at the input of the extension module is no longer a decoded signal but a signal extracted after analysis, like the coefficients of the linear prediction filter of the first frequency band used in the method for determining the optimized scale factor in an implementation of the invention.

Figure 4:
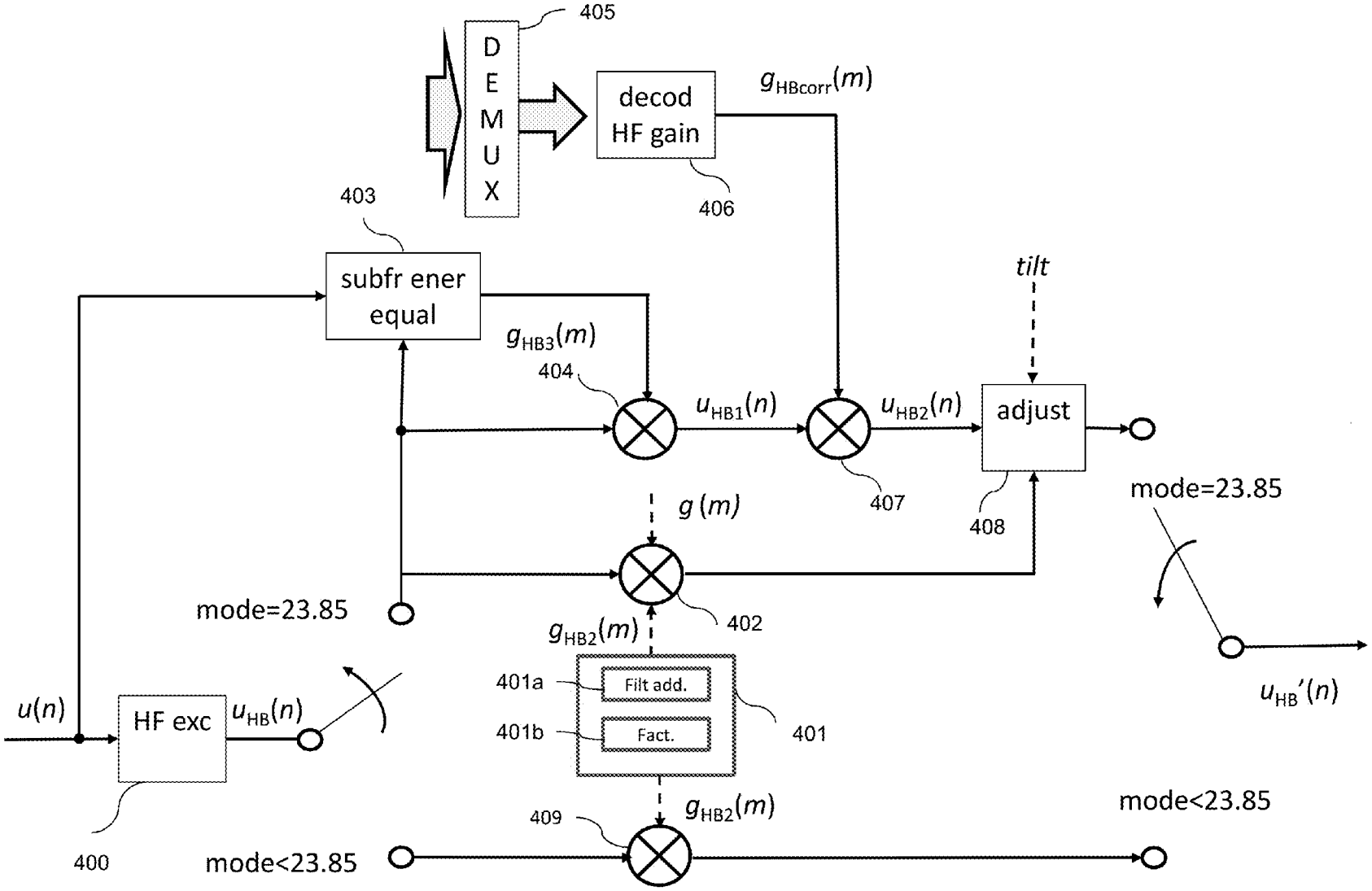
FIG. 4 illustrates a device for determining a scale factor optimized by a subframe as a function of the bit rate, according to an embodiment of the invention.

In the example illustrated in FIG. 4, the case of the bit rates <23.85 kbit/s, for which the determination of the optimized scale factor is limited to the block 401, is considered first.

In this case, an optimized scale factor denoted $g_{HB2}(m)$ is computed. In one embodiment, this computation is performed preferentially for each subframe and it consists in equalizing the levels of the frequency responses of the LPC filters $1/\hat{A}(z)$ and $1/\hat{A}(z/\gamma)$ used in low and high frequencies, as described later with reference to FIG. 7, with additional precautions to avoid the cases of overestimations which can result in an excessive energy of the synthesized high band and therefore generate audible artifacts.

In an alternative embodiment, it will be possible to keep the extrapolated HF synthesis filter $1/\hat{A}^{ext}(z/\gamma)$ as implemented in the AMR-WB decoder or a decoder that can interwork with the AMR-WB coder/decoder, for example according to the ITU-T recommendation G.718, in place of the filter $1/\hat{A}(z/\gamma)$. The compensation according to the invention is then performed from the filters $1/\hat{A}(z)$ and $1/\hat{A}^{ext}(z/\gamma)$.

The determination of the optimized scale factor is also performed by the determination (in 401*a*) of a linear prediction filter called additional filter, of lower order than the linear prediction filter of the first frequency band $1/\hat{A}(z)$, the coefficients of the additional filter being obtained from the parameters decoded or extracted from the first frequency band. The optimized scale factor is then computed (in 401*b*) as a function at least of these coefficients to be applied to the extended excitation signal $u_{HB}(n)$.

Figure 5A:
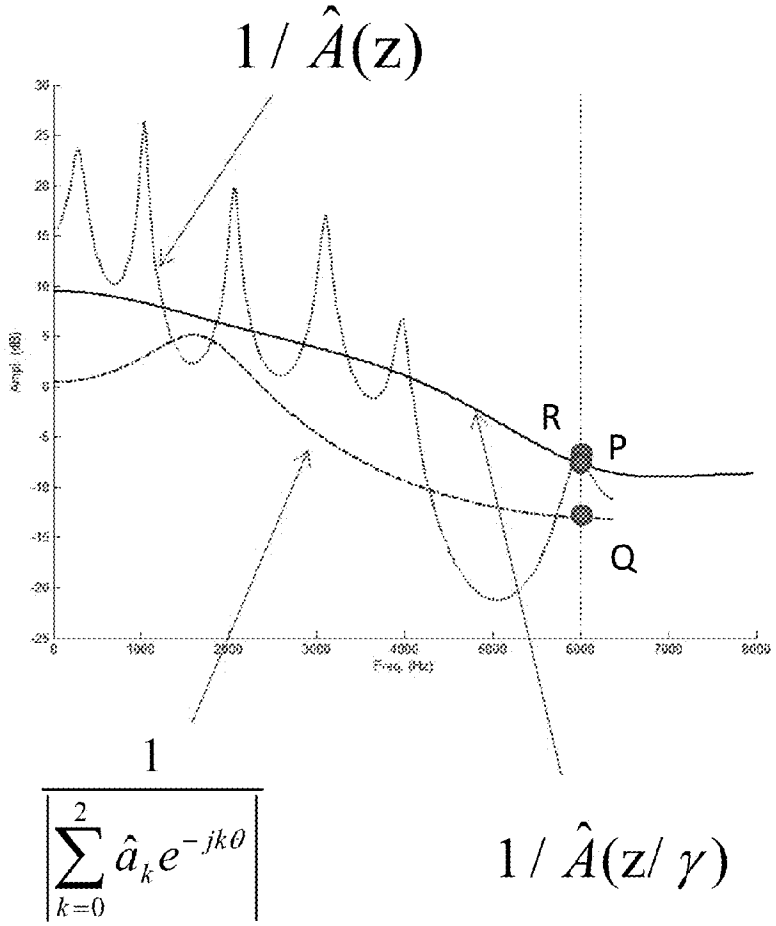
FIGS. 5*a* and 5*b* illustrate the frequency responses of the filters used for the computation of the optimized scale factor according to an embodiment of the invention.
Figure 5B:
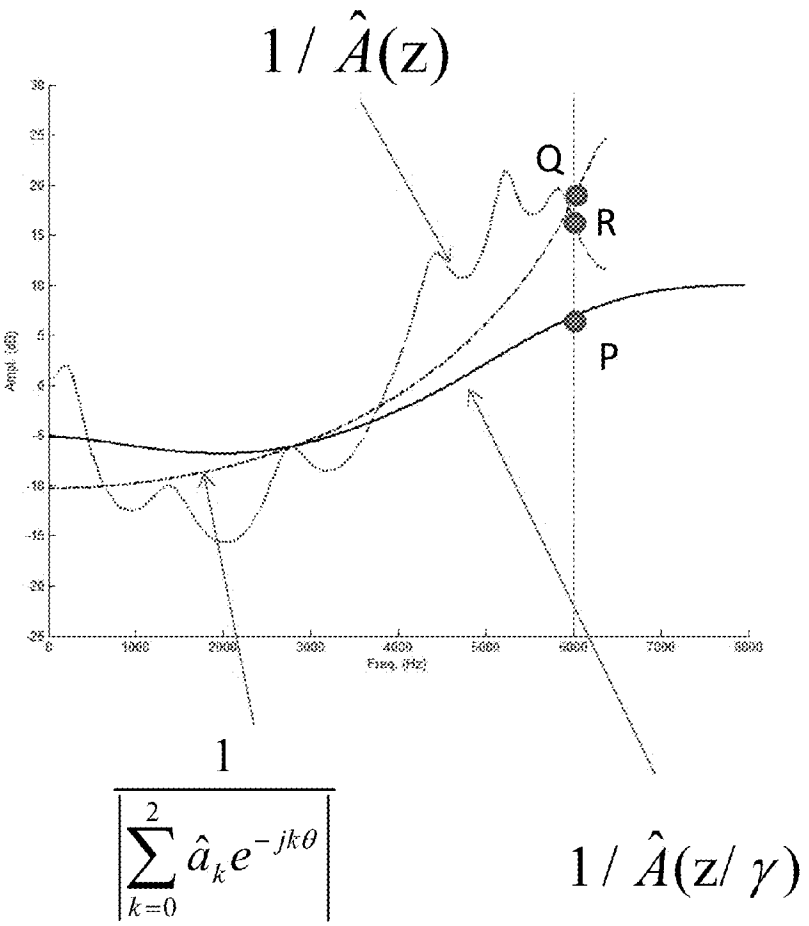

The principle of the determination of the optimized scale factor, implemented in the block 401, is illustrated in FIGS. 5*a* and 5*b* with concrete examples obtained from signals sampled at 16 kHz; the frequency response amplitude values, denoted R, P, Q below, of 3 filters are computed at the common frequency of 6000 Hz (vertical dotted line) in the current subframe, of which the index m is not recalled here in the notations of the LPC filters interpolated by subframe to lighten the text. The value of 6000 Hz is chosen such that it is close to the Nyquist frequency of the low band, that is 6400 Hz. It is preferable not to take this Nyquist frequency to determine the optimized scale factor. Indeed, the energy of the decoded signal in low frequencies is typically already attenuated at 6400 Hz. Furthermore, the band extension described here is performed on a second frequency band, called high band, which ranges from 6000 to 8000 Hz. It should be noted that, in variants of the invention, a frequency other than 6000 Hz will be able to be chosen, with no loss of generality for determining the optimized scale factor. It will also be possible to consider the case where the two LPC filters are defined for the separate bands (as in AMR-WB+). In this case, R, P and Q will be computed at the separation frequency.

FIGS. 5*a* and 5*b* illustrate how the quantities R, P, Q are defined.

The first step consists in computing the frequency responses R and P respectively of the linear prediction filter of the first frequency band (low band) and of the second frequency band (high band) at the frequency of 6000 Hz. The following is first computed:

$$R = \frac{1}{\left|\hat{A}(e^{j\theta})\right|} = \frac{1}{\left|\sum_{i=0}^{M} \hat{a}_i e^{-ji\theta}\right|}$$

in which M=16 is the order of the decoded LPC filter, $1/\hat{A}(z)$, and θ corresponds to the frequency of 6000 Hz normalized for the sampling frequency of 12.8 kHz, that is:

$$\theta = 2\pi \frac{6000}{12800}.$$

Then, similarly, the following is computed:

$$P = \frac{1}{\left|\hat{A}(e^{j\theta'}/\gamma)\right|} = \frac{1}{\left|\sum_{i=0}^{M} \hat{a}_i \gamma^i e^{-ji\theta'}\right|}$$

in which $$\theta' = 2\pi \frac{6000}{16000}.$$

In a preferred embodiment, the quantities P and R are computed according to the following pseudo-code:

```
px=py=0
rx=ry=0
for i=0 to 16
    px=px+Ap[i]*exp_tab_p[i]
    py=py+Ap[i]*exp_tab_p[33-i]
    rx=rx+Aq[i]*exp_tab_q[i]
    ry=ry+Aq[i]*exp_tab_q[33-i]
end for
P=1/sqrt(px*px+py*py)
R=1/sqrt(rx*rx+ry*ry)
```

in which $Aq[i]=\hat{a}_i$ corresponds to the coefficients of $\hat{A}(z)$ (of order 16), $Ap[i]=\gamma^i\hat{a}_i$ corresponds to the coefficient of $\hat{A}(z/\gamma)$, sqrt( ) corresponds to the square root operation and the tables exp_tab_p and exp_tab_q of size 34 contain the real and imaginary parts of the complex exponentials associated with the frequency of 6000 Hz, with $$\text{exp_tab_p}[i] = \begin{cases} \cos\left(2\pi \frac{6000}{12800} i\right) & i = 0, \ldots, 16 \\ -\sin\left(2\pi \frac{6000}{12800}(33 - i)\right) & i = 17, \ldots, 33 \end{cases}$$

-continued $$\text{exp_tab_q}[i] = \begin{cases} \cos\left(2\pi\frac{6000}{16000}i\right) & i = 0, \ldots, 16 \\ -\sin\left(2\pi\frac{6000}{16000}(33-i)\right) & i = 17, \ldots, 33 \end{cases}$$

The additional prediction filter is obtained for example by suitably truncating the polynomial $\hat{A}(z)$ to the order 2.

In fact, the direct truncation to the order leads to the filter $1+\hat{a}_1+\hat{a}_2$, which can pose a problem because there is generally nothing to guarantee that this filter of order 2 is stable. In a preferred embodiment, the stability of the filter $1+\hat{a}_1+\hat{a}_2$ is therefore detected and a filter $1+\hat{a}_1+\hat{a}_2'$ is used, the coefficients of which are drawn from $1+\hat{a}_1+\hat{a}_2$ as a function of the instability detection. More specifically, the following are initialized:

$$\hat{a}_1'=\hat{a}_i,\ i=1,2$$

The stability of the filter $1+\hat{a}_1+\hat{a}_2$ can be verified differently; here, a conversion is used in the PARCOR coefficients (or reflection coefficients) domain by computing:

$$k_1=\hat{a}_1'/(1+\hat{a}_2')$$

$$k_2=\hat{a}_2'$$

The stability is verified if $|k_i|<1$, i=1, 2. The value of $k_i$ is therefore conditionally modified before ensuring the stability of the filter, with the following steps:

$$k_2 \leftarrow \begin{cases} \min(0.6, k_2) & k_2 > 0 \\ \max(-0.6, k_2) & k_2 < 0 \end{cases}$$

$$k_1 \leftarrow \begin{cases} \min(0.99, k_2) & k_1 > 0 \\ \max(-0.99, k_2) & k_1 < 0 \end{cases}$$

in which min(.,.) and max(.,.) respectively give the minimum and the maximum of 2 operands.

It should be noted that the threshold values, 0.99 for $k_1$ and 0.6 for $k_2$, will be able to be adjusted in variants of the invention. It will be recalled that the first reflection coefficient, $k_1$, characterizes the spectral slope (or tilt) of the signal modeled to the order 1; in the invention the value of $k_1$ is saturated at a value close to the stability limit, in order to preserve this slope and retain a tilt similar to that of $1/\hat{A}(z)$. It will also be recalled that the second reflection coefficient, $k_2$, characterizes the resonance level of the signal modeled to the order 2; since the use of a filter of order 2 aims to eliminate the influence of such resonances around the frequency of 6000 Hz, the value of $k_2$ is more strongly limited; this limit is set at 0.6.

The coefficients of $1+\hat{a}_1+\hat{a}_2'$ are then obtained by:

$$\hat{a}_1'=(1+k_2)k_1$$

$$\hat{a}_2'=k_2$$

The frequency response of the additional filter is therefore finally computed:

$$Q = \frac{1}{\left|\sum_{k=0}^{2} \hat{a}_k' e^{-jk\theta}\right|}$$

-continued $$\text{with } \theta = 2\pi\frac{6000}{12800}.$$

This quantity is computed preferentially according to the following pseudo-code:

```
qx = qy = 0
for i=0 to 2
    qx = qx + As[i]*exp_tab_q[i];
    qy = qy + As[i]*exp_tab_q[33-i];
end for
Q = 1/sqrt(qx*qx+qy*qy)
```

in which $As[i]=\hat{a}_i'$.

With no loss of generality, it will be possible to compute the coefficients of the filter of order 2 otherwise, for example by applying to the LPC filter $\hat{A}(z)$ of order 16 the reduction procedure of the LPC order called "STEP DOWN" described in J. D. Markel and A. H. Gray, Linear Prediction of Speech, Springer Verlag, 1976 or by performing two Levinson-Durbin (or STEP-UP) algorithm iterations from the self-correlations computed on the signal synthesized (decoded) at 12.8 kHz and windowed.

For some signals, the quantity Q, computed from the first 3 LPC coefficients decoded, better takes account of the influence of the spectral slope (or tilt) in the spectrum and avoids the influence of "spurious" peaks or troughs close to 6000 Hz which can skew or raise the value of the quantity R, computed from all the LPC coefficients.

In a preferred embodiment, the optimized scale factor is deduced from the precomputed quantities R, P, Q conditionally, as follows:

If the tilt (computed as in AMR-WB in the block 104, by normalized self-correlation in the form r(1)/r(0) in which r(i) is the self-correlation) is negative (tilt <0 as represented in FIG. 5*b*), the computation of the scale factor is done as follows:

to avoid artifacts due to excessively abrupt variations of energy of the high band, a smoothing is applied to the value of R. In a preferred embodiment, an exponential smoothing is performed with a fixed factor in time (0.5) in the form of:

$$R=0.5R+0.5R_{prev}$$

$$R_{prev}=R$$

in which $R_{prev}$ corresponds to the value of R in the preceding subframe and the factor 0.5 is optimized empirically—obviously, the factor 0.5 will be able to be changed for another value and other smoothing methods are also possible. It should be noted that the smoothing makes it possible to reduce the temporal variants and therefore avoid artifacts. The optimized scale factor is then given by:

$$g_{HB2}(m)=\max(\min(R,Q),P)/P$$

In an alternative embodiment, it will be possible to replace the smoothing of R with a smoothing of $g_{HB2}(m)$ such that:

$$g_{HB2}(m)\leftarrow 0.5g_{HB2}(m)+0.5g_{HB2}(m-1)$$

If the tilt (computed as in AMR-WB in the block 104) is positive (tilt >0 as in FIG. 5*a*), the computation of the scale factor is done as follows:

the quantity R is smoothed adaptively in time, with a stronger smoothing when R is low as in the preceding case, this smoothing makes it possible to reduce the temporal variants and therefore avoids artifacts:

$$R=(1-\alpha)R+\alpha R_{prev} \text{ with } \alpha=1-R^2$$

$$R_{prev}=R$$

Then, the optimized scale factor is given by:

$$g_{HB2}=\min(R,P\ Q)/P$$

In an alternative embodiment, it will be possible to replace the smoothing of R with a smoothing of $g_{HB2}(m)$ as computed above.

$$g_{HB}(m)=(1-\alpha)g_{HB}(m)+\alpha g_{HB}(m-1), m=0, \ldots, 3, \alpha=1-g_{HB}^2(m)$$

where $g_{HB}(-1)$ is the scale or gain factor computed for the last subframe of the preceding frame.

The minimum of R, P, Q is taken here in order to avoid overestimating the scale factor.

In a variant, the above condition depending only on the tilt will be able to be extended to take account not only of the tilt parameter but also of other parameters in order to refine the decision. Furthermore, the computation of $g_{HB2}(m)$ will be able to be adjusted according to these said additional parameters.

An example of additional parameter is the number of zero crossings (ZCR, zero crossing rate) which can be defined as:

$$zcr_s = \frac{1}{2}\sum_{n=1}^{N-1}|\mathrm{sgn}[s(n)] - \mathrm{sgn}[s(n-1)]|$$

in which $$\mathrm{sgn}(x) = \begin{cases} 1 & \text{if } x \geq 0 \\ -1 & \text{if } x < 0 \end{cases}$$

The parameter zcr generally gives results similar to the tilt. A good classification criterion is the ratio between zcr computed for the synthesized signal s(n) and $zcr_u$ computed for the excitation signal u(n) at 12 800 Hz. This ratio is between 0 and 1, where 0 means that the signal has a decreasing spectrum, 1 that the spectrum is increasing (which corresponds to (1−tilt)/2. In this case, a ratio $zcr_s/zcr_u>0.5$ corresponds to the case tilt <0, a ratio $zcr_s/zcr_u<0.5$ corresponds to tilt >0. In a variant, it will be possible to use a function of a parameter $tilt_{hp}$ where $tilt_{hp}$ is the tilt computed for the synthesized signal s(n) filtered by a high-pass filter with a cut-off frequency for example at 4800 Hz; in this case, the response $1/\hat{A}(z/\gamma)$ from 6 to 8 kHz (applied at 16 kHz) corresponds to the weighted response of $1/\hat{A}(z)$ from 4.8 to 6.4 kHz. Since $1/\hat{A}(z/\gamma)$ has a more flattened response, it is necessary to compensate this change of tilt. The scale factor function according to $tilt_{hp}$ is then given in an embodiment by: $(1-tilt_{hp})^2+0.6$. Q and R are therefore multiplied by $\min(1, (1-tilt_{hp})^2+0.6)$ when tilt >0 or by $\max(1, (1-tilt_{hp})^2+0.6)$ when tilt <0.

The case of the 23.85 kbit/s bit rate is now considered, for which a gain correction is performed by the blocks 403 to 408. This gain correction could moreover be the subject of a separate invention. In this particular embodiment according to the invention, the gain correction information, denoted $g_{HBcorr}(m)$, transmitted by the AMR-WB (compatible) coding with a bit rate of 0.8 kbit/s, is used to improve the quality at 23.85 kbit/s.

It is assumed here that the AMR-WB (compatible) coding has performed a correction gain quantization on 4 bits as described in ITU-T clause G.722.2/5.11 or, equivalently, in the 3GPP clause TS 26.190/5.11.

In the AMR-WB coder, the correction gain is computed by comparing the energy of the original signal sampled at 16 kHz and filtered by a 6-7 kHz bandpass filter, $s_{HB}(n)$, with the energy of the white noise at 16 kHz filtered by a synthesis filter $1/\hat{A}(z/\gamma)$ and a 6-7 kHz bandpass filter (before the filtering, the energy of the noise is set to a level similar to that of the excitation at 12.8 kHz), $s_{HB2}(n)$. The gain is the root of the ratio of energy of the original signal to the energy of the noise divided by two. In one possible embodiment, it will be possible to change the bandpass filter for a filter with a wider band (for example from 6 to 7.6 kHz).

$$g_{HBcorr}(m) = \sqrt{\frac{\sum_{n=80m}^{80(m+1)-1} s_{HB}(n)^2}{\sum_{n=80m}^{80(m+1)-1} s_{HB2}(n)^2}}, m = 0, \ldots, 3$$

To be able to apply the gain information received at 23.85 kbit/s (in the block 407), it is important to bring the excitation to a level similar to that expected of the AMR-WB (compatible) coding. Thus, the block 404 performs the scaling of the excitation signal according to the following equation:

$$u_{HB1}(n)=g_{HB3}(m)u_{HB}(n), n=80m, \ldots, 80(m+1)-1$$

in which $g_{HB3}(m)$ is a gain per subframe computed in the block 403 in the form:

$$g_{HB3}(m) = \sqrt{\frac{\sum_{n=0}^{63} u(n)^2}{5 \cdot \sum_{n=0}^{79} u_{HB}(n)^2}}$$

in which the factor 5 in the denominator serves to compensate the bandwidth difference between the signal u(n) and the signal $u_{HB}(n)$, given that, in the AMR-WB coding, the HF excitation is a white noise over the 0-8000 Hz band.

The index of 4 bits per subframe, denoted $index_{HF_gain}(m)$, sent at 23.85 kbit/s is demultiplexed from the bit stream (block 405) and decoded by the block 406 as follows:

$$g_{HBcorr}(m)=2\cdot HP_\mathrm{gain}(index_{HF_gain}(m))$$

in which HP_gain(.) is the HF gain quantization dictionary defined in the AMR-WB coding and recalled below:

TABLE 1

(gain dictionary at 23.85 kbit/s)

| i | HP_gain(i) |
|---|---|
| 0 | 0.110595703125000 |
| 1 | 0.142608642578125 |
| 2 | 0.170806884765625 |
| 3 | 0.197723388671875 |
| 4 | 0.226593017578125 |
| 5 | 0.255676269531250 |
| 6 | 0.284545898437500 |
| 7 | 0.313232421875000 |
| 8 | 0.342102050781250 |
| 9 | 0.372497558593750 |
| 10 | 0.408660888671875 |
| 11 | 0.453002929687500 |
| 12 | 0.511779785156250 |

TABLE 1-continued

| (gain dictionary at 23.85 kbit/s) | |
|---|---|
| i | HP_gain(i) |
| 13 | 0.599822998046875f |
| 14 | 0.741241455078125 |
| 15 | 0.998779296875000 |

The block 407 performs the scaling of the excitation signal according to the following equation:

$$u_{HB2}(n)=g_{HBcorr}(m)u_{HB1}(n),\ n=80m,\ldots,80(m+1)-1$$

Finally, the energy of the excitation is adjusted to the level of the current subframe with the following conditions (block 408). The following is computed:

$$fac(m)=\sqrt{\frac{\sum_{n=0}^{79}(g(m)g_{HB2}(m)u_{HB}(n))^2}{\sum_{n=0}^{79}u_{HB2}(n)^2}}$$

The numerator here represents the high-band signal energy which would be obtained in the mode 23.05. As explained before, for the bit rates <23.85 kbit/s, it is necessary to retain the level of energy between the decoded excitation signal and the extended excitation signal $u_{HB}(n)$, but this constraint is not necessary in the case of the 23.85 kbit/s bit rate, since $u_{HB}(n)$ is in this case scaled by the gain $g_{HB3}(m)$. To avoid double multiplications, certain multiplication operations applied to the signal in the block 400 are applied in the block 402 by multiplying by g(m). The value of g(m) depends on the $u_{HB}(n)$ synthesis algorithm and must be adjusted such that the energy level between the decoded excitation signal in low band and the signal $g(m)u_{HB}(n)$ is retained.

In a particular embodiment, which will be described in detail later with reference to FIG. 7, $g(m)=0.6g_{HB1}(m)$, where $g_{HB1}(m)$ is a gain which ensures, for the signal $u_{HB}$, the same ratio between energy per subframe and energy per frame as for the signal u(n) and 0.6 corresponds to the average frequency response amplitude value of the de-emphasis filter from 5000 to 6400 Hz.

It is assumed that, in the block 408, there is information on the tilt of the low-band signal—in a preferred embodiment, this tilt is computed as in the AMR-WB codec according to the blocks 103 and 104, but other methods for estimating the tilt are possible without changing the principle of the invention.

If fac(m)>1 or tilt<0, the following is assumed:

$$u_{HB}'(n)=u_{HB2}(n),\ n=80m,\ldots,80(m+1)-1$$

Otherwise:

$$u_{HB}'(n)=\max(\sqrt{1-\text{tilt}},\text{fac}(m))\cdot u_{HB2}(n),\ n=80m,\ldots,80(m+1)-1$$

It will be noted that the optimized scale factor computation described here, notably in the blocks 401 and 402, is distinguished from the abovementioned equalization of filter levels performed in the AMR-WB+ codec by a number of aspects:

- The optimized scale factor is computed directly from the transfer functions of the LPC filters without involving any temporal filtering. This simplifies the method.
- The equalization is done preferentially at a frequency different from the Nyquist frequency (6400 Hz) associated with the low band. Indeed, the LPC modeling implicitly represents the attenuation of the signal typically caused by the resampling operations and therefore the frequency response of an LPC filter may be subject at the Nyquist frequency to a decrease which is not at the chosen common frequency.
- The equalization here relies on a filter of lower order (here of order 2) in addition to the 2 filters to be equalized. This additional filter makes it possible to avoid the effects of local spectral fluctuations (peaks or troughs) which may be present at the common frequency for the computation of the frequency response of the prediction filters.

For the blocks 403 to 408, the advantage of the invention is that the quality of the signal decoded at 23.85 kbit/s according to the invention is improved relative to a signal decoded at 23.05 kbit/s, which is not the case in an AMR-WB decoder. In fact, this aspect of the invention makes it possible to use the additional information (0.8 kbit/s) received at 23.85 kbit/s, but in a controlled manner (block 408), to improve the quality of the extended excitation signal at the bit rate of 23.85.

The device for determining the optimized scale factor as illustrated by the blocks 401 to 408 of FIG. 4 implements a method for determining the optimized scale factor now described with reference to FIG. 6.

The main steps are implemented by the block 401.

Thus, an extended excitation signal $u_{HB}(n)$ is obtained in a frequency band extension method E601 which comprises a step of decoding or of extraction, in a first frequency band called low band, of an excitation signal and of parameters of the first frequency band such as, for example, the coefficients of the linear prediction filter of the first frequency band.

A step E602 determines a linear prediction filter called additional filter, of lower order than that of the first frequency band. To determine this filter, the parameters of the first frequency band decoded or extracted are used.

In one embodiment, this step is performed by truncation of the transfer function of the linear prediction filter of the low band to obtain a lower filter order, for example 2. These coefficients can then be modified as a function of a stability criterion as explained previously with reference to FIG. 4.

From the coefficients of the additional filter thus determined, a step E603 is implemented to compute the optimized scale factor to be applied to the extended excitation signal. This optimized scale factor is, for example, computed from the frequency response of the additional filter at a common frequency between the low band (first frequency band) and the high band (second frequency band). A minimum value can be chosen between the frequency response of this filter and those of the low-band and high-band filters. This therefore avoids the overestimations of energy which could exist in the methods of the prior art.

This step of computation of the optimized scale factor is, for example, described previously with reference to FIG. 4 and FIGS. 5*a* and 5*b*.

The step E604 performed by the block 402 or 409 (depending on the decoding bit rate) for the band extension, applies the duly computed optimized scale factor to the extended excitation signal so as to obtain an optimized extended extension signal $u_{HB}'(n)$.

In a particular embodiment, the device for determining the optimized scale factor 708 is incorporated in a band extension device now described with reference to FIG. 7. This device for determining the optimized scale factor illustrated by the block 708 implements the method for determining the optimized scale factor described previously with reference to FIG. 6.

In this embodiment, the band extension block 400 of FIG. 4 comprises the blocks 700 to 707 of FIG. 7 that is now described.

Thus, at the input of the band extension device, a low-band excitation signal decoded or estimated by analysis is received (u(n)). The band extension here uses the excitation decoded at 12.8 kHz (exc2 or u(n)) at the output of the block 302 of FIG. 3.

It will be noted that, in this embodiment, the generation of the oversampled and extended excitation is performed in a frequency band ranging from 5 to 8 kHz therefore including a second frequency band (6.4-8 kHz) above the first frequency band (0-6.4 kHz).

Thus, the generation of an extended excitation signal is performed at least over the second frequency band but also over a part of the first frequency band.

Obviously, the values defining these frequency bands can be different depending on the decoder or the processing device in which the invention is applied.

For this exemplary embodiment, this signal is transformed to obtain an excitation signal spectrum U(k) by the time-frequency transformation module 500.

In a particular embodiment, the transform uses a DCT-IV (for "Discrete Cosine Transform"—type IV) (block 700) on the current frame of 20 ms (256 samples), without windowing, which amounts to directly transforming u(n) with n=0, . . . , 255 according to the following formula:

$$U(k) = \sum_{n=0}^{N-1} u(n)\cos\left(\frac{\pi}{N}\left(n+\frac{1}{2}\right)\left(k+\frac{1}{2}\right)\right)$$

in which N=256 and k=0, . . . , 255.

It should be noted here that the transformation without windowing (or, equivalently, with an implicit rectangular window of the length of the frame) is possible because the processing is performed in the excitation domain, and not the signal domain so that no artifact (block effects) is audible, which constitutes an important advantage of this embodiment of the invention.

In this embodiment, the DCT-IV transformation is implemented by FFT according to the so-called "Evolved DCT (EDCT)" algorithm described in the article by D. M. Zhang, H. T. Li, *A Low Complexity Transform-Evolved DCT*, IEEE 14th International Conference on Computational Science and Engineering (CSE), August 2011, pp. 144-149, and implemented in the ITU-T standards G.718 Annex B and G.729.1 Annex E.

In variants of the invention, and without loss of generality, the DCT-IV transformation will be able to be replaced by other short-term time-frequency transformations of the same length and in the excitation domain, such as an FFT (for "Fast Fourier Transform") or a DCT-II (Discrete Cosine Transform—type II). Alternatively, it will be possible to replace the DCT-IV on the frame by a transformation with overlap-addition and windowing of length greater than the length of the current frame, for example by using an MDCT (for "Modified Discrete Cosine Transform"). In this case, the delay T in the block 310 of FIG. 3 will have to be adjusted (reduced) appropriately as a function of the additional delay due to the analysis/synthesis by this transform.

The DCT spectrum, U(k), of 256 samples covering the 0-6400 Hz band (at 12.8 kHz), is then extended (block 701) into a spectrum of 320 samples covering the 0-8000 Hz band (at 16 kHz) in the following form:

$$U_{HB1}(k) = \begin{cases} 0 & k = 0, \ldots, 199 \\ U(k) & k = 200, \ldots, 239 \\ U(k + \text{start_band} - 240) & k = 240, \ldots, 319 \end{cases}$$

in which it is preferentially taken that start_band=160.

The block 701 operates as module for generating an oversampled and extended excitation signal and performs a resampling from 12.8 to 16 kHz in the frequency domain, by adding ¼ of samples (k=240, . . . , 319) to the spectrum, the ratio between 16 and 12.8 being 5/4.

Furthermore, the block 701 performs an implicit high-pass filtering in the 0-5000 Hz band since the first 200 samples of $U_{HB1}(k)$ are set to zero; as explained later, this high-pass filtering is also complemented by a part of progressive attenuation of the spectral values of indices k=200, . . . , 255 in the 5000-6400 Hz band; this progressive attenuation is implemented in the block 704 but could be performed separately outside of the block 704. Equivalently, and in variants of the invention, the implementation of the high-pass filtering separated into blocks of coefficients of index k=0, . . . , 199 set to zero, of attenuated coefficients k=200, . . . , 255 in the transformed domain, will therefore be able to be performed in a single step.

In this exemplary embodiment and according to the definition of $U_{HB1}(k)$, it will be noted that the 5000-6000 Hz band of $U_{HB1}(k)$ (which corresponds to the indices k=200, . . . , 239) is copied from the 5000-6000 Hz band of U(k). This approach makes it possible to retain the original spectrum in this band and avoids introducing distortions in the 5000-6000 Hz band upon the addition of the HF synthesis with the LF synthesis—in particular the phase of the signal (implicitly represented in the DCT-IV domain) in this band is preserved.

The 6000-8000 Hz band of $U_{HB1}(k)$ is here defined by copying the 4000-6000 Hz band of U(k) since the value of start_band is preferentially set at 160.

In a variant of the embodiment, the value of start_band will be able to be made adaptive around the value of 160. The details of the adaptation of the start_band value are not described here because they go beyond the framework of the invention without changing its scope.

For certain wide-band signals (sampled at 16 kHz), the high band (>6 kHz) may be noisy, harmonic or comprise a mixture of noise and harmonics. Furthermore, the level of harmonicity in the 6000-8000 Hz band is generally correlated with that of the lower frequency bands. Thus, the noise generation block 702 performs a noise generation in the frequency domain, $U_{HBN}(k)$ for k=240, . . . , 319 (80 samples) corresponding to a second frequency band called high frequency in order to then combine this noise with the spectrum $U_{HB1}(k)$ in the block 703.

In a particular embodiment, the noise (in the 6000-8000 Hz band) is generated pseudo-randomly with a linear congruential generator on 16 bits:

$$U_{HBN}(k) = \begin{cases} 0 & k = 0, \ldots, 239 \\ 31821 U_{HBN}(k-1) + 13849 & k = 240, \ldots, 319 \end{cases}$$

with the convention that $U_{HBN}(239)$ in the current frame corresponds to the value $U_{HBN}(319)$ of the preceding frame. In variants of the invention, it will be possible to replace this noise generation by other methods.

The combination block 703 can be produced in different ways. Preferentially, an adaptive additive mixing of the following form is considered:

$$U_{HB2}(k)=\beta U_{HB1}(k)+\alpha G_{HBN}U_{HBN}(k),\ k=240,\ldots,319$$

in which $G_{HBN}$ is a normalization factor serving to equalize the level of energy between the two signals, $$G_{HBN}=\sqrt{\frac{\sum_{k=240}^{319}U_{HB1}(k)^2+\varepsilon}{\sum_{k=240}^{319}U_{HBN}(k)^2+\varepsilon}}$$

with ε=0.01, and the coefficient α (between 0 and 1) is adjusted as a function of parameters estimated from the decoded low band and the coefficient β (between 0 and 1) depends on α.

In a preferred embodiment, the energy of the noise is computed in three bands: 2000-4000 Hz, 4000-6000 Hz and 6000-8000 Hz, with $$E_{N2-4}=\sum_{k\in N(80,159)}U'^2(k)$$

$$E_{N4-6}=\sum_{k\in N(160,239)}U'^2(k)$$

$$E_{N4-6}=\sum_{k\in N(240,319)}U'^2(k)$$

in which $$U'(k)=\begin{cases}\sqrt{\dfrac{\sum_{k=160}^{239}U^2(k)}{\sum_{k=80}^{159}U^2(k)}}\,U(k) & k=80,\ldots,159\\ U(k) & k=160,\ldots,239\\ \sqrt{\dfrac{\sum_{k=160}^{239}U^2(k)}{\sum_{k=240}^{319}U_{HB1}^2(k)}}\,U_{HB1}(k) & k=240,\ldots,319\end{cases}$$

and $N(k_1,k_2)$ is the set of the indices k for which the coefficient of index k is classified as being associated with the noise. This set can, for example be obtained by detecting the local peaks in U'(k) that verify $|U'(k)|\geq U'(k-1)|$ and $|U'(k)|\geq|U'(k+1)|$ and by considering that these rays are not associated with the noise, i.e. (by applying the negation of the preceding condition):

$$N(a,b)=\{a\leq k\leq b\,|\,|U'(k)|<|U'(k-1)|\text{ or }|U'(k)|<|U'(k+1)|\}$$

It can be noted that other methods for computing the energy of the noise are possible, for example by taking the median value of the spectrum on the band considered or by applying a smoothing to each frequency ray before computing the energy per band.

α is set such that the ratio between the energy of the noise in the 4-6 kHz and 6-8 kHz bands is the same as between the 2-4 kHz and 4-6 kHz bands:

$$\alpha=\sqrt{\frac{\rho-E_{N6-8}}{\sum_{k=160}^{239}U^2(k)-E_{N6-8}}}$$

in which $$E_{N4-6}=\max(E_{N4-6},E_{N2-4}),\ \rho=\frac{E_{N4-6}^2}{E_{N2-4}},\ \rho=\max(\rho,E_{N6-8})$$

In variants of the invention, the computation of α will be able to be replaced by other methods. For example, in a variant, it will be possible to extract (compute) different parameters (or "features") characterizing the signal in low band, including a "tilt" parameter similar to that computed in the AMR-WB codec, and the factor α will be estimated as a function of a linear regression from these different parameters by limiting its value between 0 and 1. The linear regression will, for example, be able to be estimated in a supervised manner by estimating the factor α by exchanging the original high band in a learning base. It will be noted that the way in which α is computed does not limit the nature of the invention.

In a preferred embodiment, the following is taken $$\beta=\sqrt{1-\alpha^2}$$

in order to preserve the energy of the extended signal after mixing.

In a variant, the factors β and α will be able to be adapted to take account of the fact that a noise injected into a given band of the signal is generally perceived as stronger than a harmonic signal with the same energy in the same band. Thus, it will be possible to modify the factors β and α as follows:

$$\beta\leftarrow\beta\cdot f(\alpha)$$

$$\alpha\leftarrow\alpha\cdot f(\alpha)$$

in which f(α) is a decreasing function of α, for example $f(\alpha)=b-a\sqrt{\alpha}$, b=1.1, a=1.2, f(α) limited from 0.3 to 1. It must be noted that, after multiplication by f(α), $\alpha^2+\beta^2<1$ so that the energy of the signal $U_{HB2}(k)=\beta U_{HB1}(k)+\alpha G_{HBN}U_{HBN}(k)$ is lower than the energy of $U_{HB1}(k)$ (the energy difference depends on α, the more noise is added, the more the energy is attenuated).

In other variants of the invention, it will be possible to take:

$$\beta=1-\alpha$$

which makes it possible to preserve the amplitude level (when the combined signals are of the same sign); however, this variant has the disadvantage of resulting in an overall energy (at the level of $U_{HB2}(k)$) which is not monotonous as a function of α.

Figure 1:
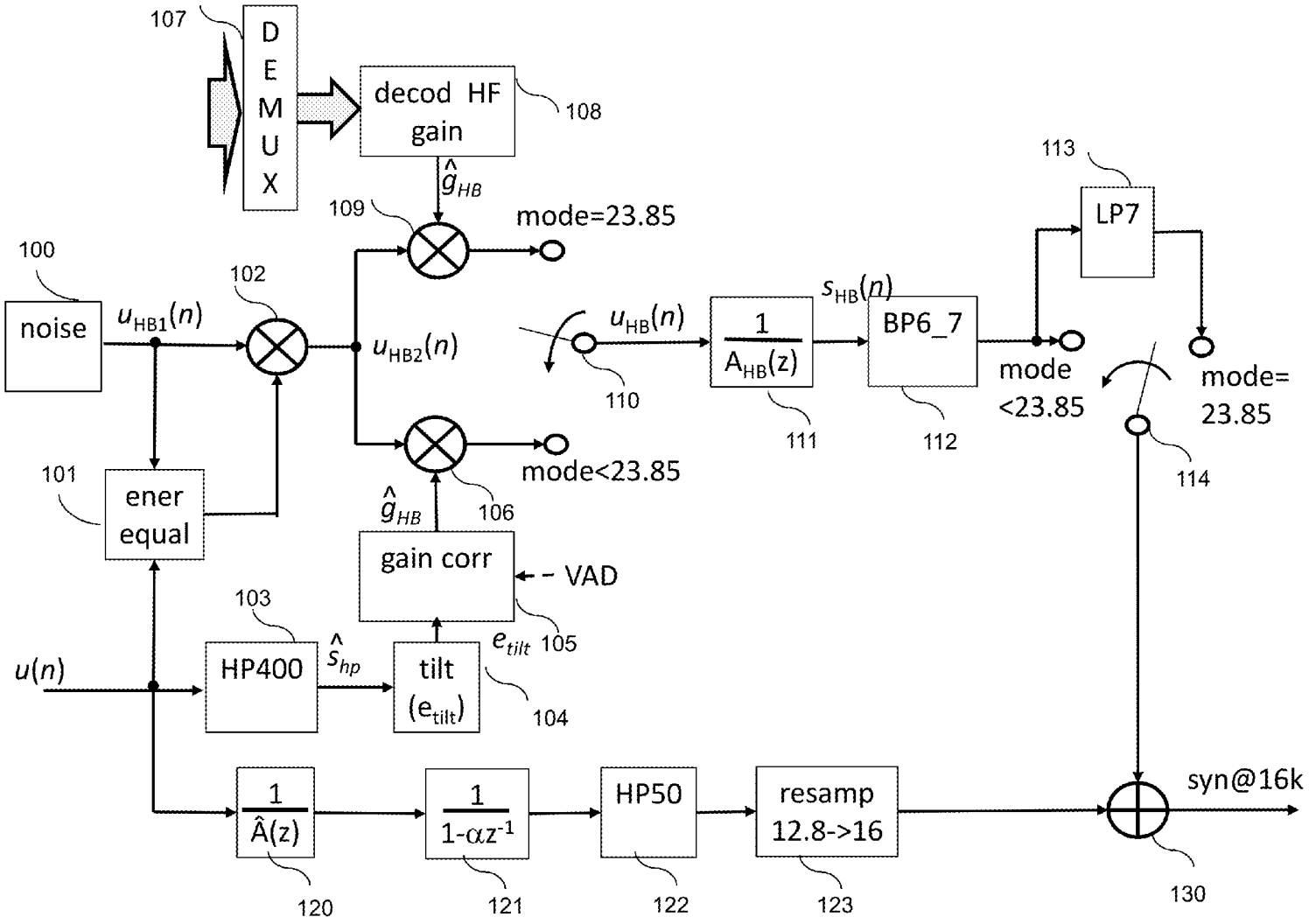
Figures 2A, 2B:
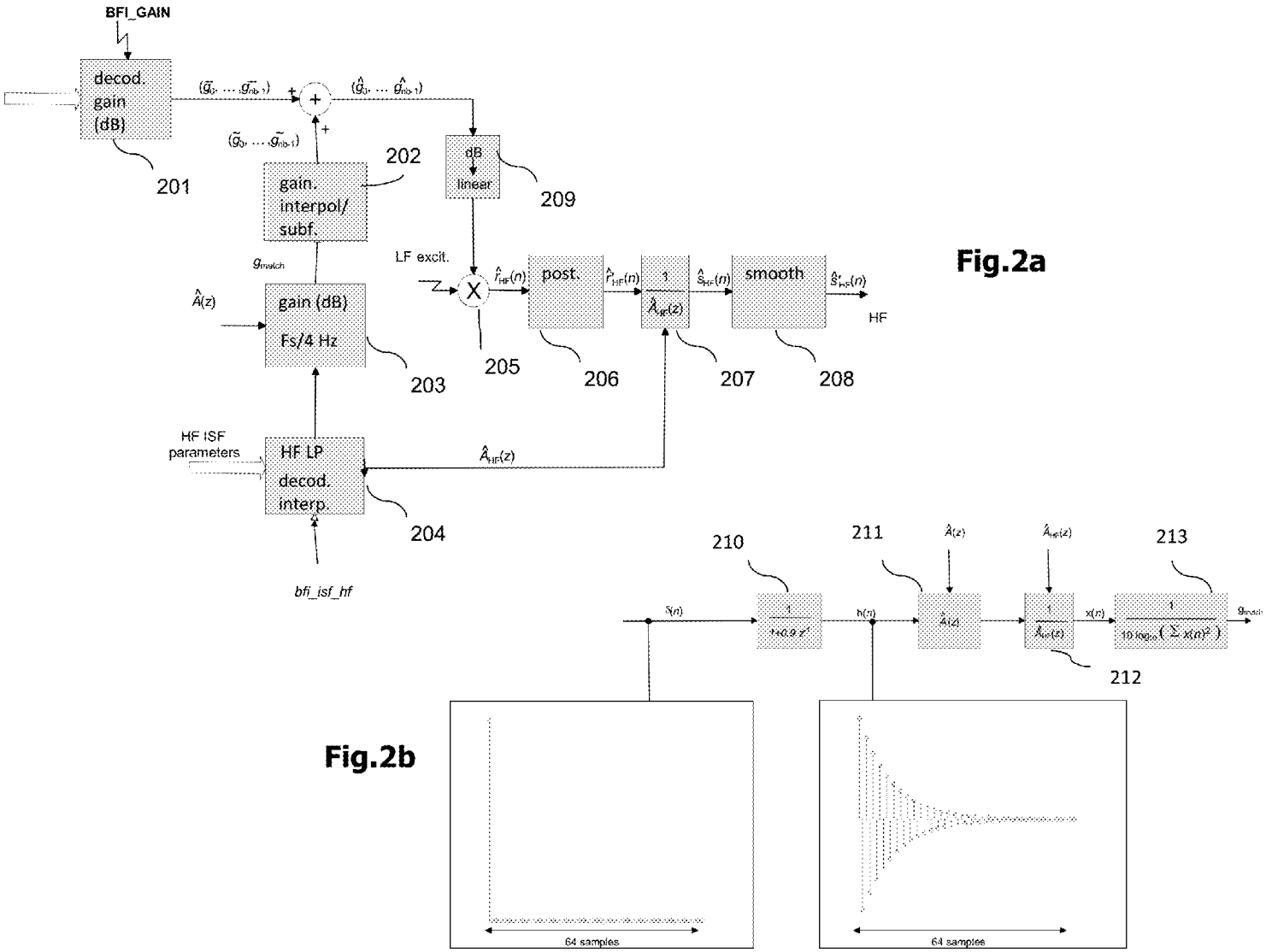

It should therefore be noted here that the block 703 performs the equivalent of the block 101 of FIG. 1 to normalize the white noise as a function of an excitation which is, by contrast here, in the frequency domain, already extended to the rate of 16 kHz; furthermore, the mixing is limited to the 6000-8000 Hz band.

In a simple variant, it is possible to consider an implementation of the block 703, in which the spectra, $U_{HB1}(k)$ or $G_{HBN}U_{HBN}(k)$, are selected (switched) adaptively, which amounts to allow only the values 0 or 1 for α; this approach amounts to classifying the type of excitation to be generated in the 6000-8000 Hz band.

The block 704 optionally performs a double operation of application of bandpass filter frequency response and of de-emphasis filtering in the frequency domain.

In a variant of the invention, the de-emphasis filtering will be able to be performed in the time domain, after the block 705, even before the block 700; however, in this case, the bandpass filtering performed in the block 704 may leave certain low-frequency components of very low levels which are amplified by de-emphasis, which can modify, in a slightly perceptible manner, the decoded low band. For this reason, it is preferred here to perform the de-emphasis in the frequency domain. In the preferred embodiment, the coefficients of index k=0, . . . , 199 are set to zero, so the de-emphasis is limited to the higher coefficients.

The excitation is first de-emphasized according to the following equation:

$$U'_{HB2}(k) = \begin{cases} 0 & k = 0, \ldots, 199 \\ G_{deemph}(k)U_{HB2}(k) & k = 200, \ldots, 255 \\ G_{deemph}(255)U_{HB2}(k) & k = 256, \ldots, 319 \end{cases}$$

in which $G_{deemph}(k)$ is the frequency response of the filter $1/(1-0.68\ z^{-1})$ over a restricted discrete frequency band. By taking into account the discrete (odd) frequencies of the DCT-IV, $G_{deemph}(k)$ is defined here as:

$$G_{deemph}(k) = \frac{1}{|e^{j\theta_k} - 0.68|}, k = 0, \ldots, 255$$

in which $$\theta_k = \frac{256 - 80 + k + \frac{1}{2}}{256}.$$

In the case where a transformation other than DCT-IV is used, the definition of $\theta_k$ will be able to be adjusted (for example for even frequencies).

It should be noted that the de-emphasis is applied in two phases for k=200, . . . , 255 corresponding to the 5000-6400 Hz frequency band, where the response $1/(1-0.68\ z^{-1})$ is applied as at 12.8 kHz, and for k=256, . . . , 319 corresponding to the 6400-8000 Hz frequency band, where the response is extended from 16 kHz here to a constant value in the 6.4-8 kHz band.

It can be noted that, in the AMR-WB codec, the HF synthesis is not de-emphasized.

In the embodiment presented here, the high frequency signal is, on the contrary, de-emphasized so as to bring it into a domain consistent with the low frequency signal (0-6.4 kHz) which leaves the block 305 of FIG. 3. This is important for the estimation and the subsequent adjustment of the energy of the HF synthesis.

In a variant of the embodiment, in order to reduce the complexity, it will be possible to set $G_{deemph}(k)$ at a constant value independent of k, by taking for example $G_{deemph}(k)$ =0.6 which corresponds approximately to the average value of $G_{deemph}(k)$ for k=200, . . . , 319 in the conditions of the embodiment described above.

In another variant of the embodiment of the extension device, the de-emphasis will be able to be performed in an equivalent manner in the time domain after inverse DCT.

In addition to the de-emphasis, a bandpass filtering is applied with two separate parts: one, high-pass, fixed, the other, low-pass, adaptive (function of the bit rate).

This filtering is performed in the frequency domain.

In the preferred embodiment, the low-pass filter partial response is computed in the frequency domain as follows:

$$G_{lp}(k) = 1 - 0.999\frac{k}{N_{lp} - 1}$$

in which $N_{lp}$=60 at 6.6 kbit/s, 40 at 8.85 kbit/s, and 20 at the bit rates >8.85 bit/s.

Then, a bandpass filter is applied in the form:

$$U_{HB3}(k) = \begin{cases} 0 & k = 0, \ldots, 199 \\ G_{hp}(k - 200)U'_{HB2}(k) & k = 200, \ldots, 255 \\ U'_{HB2}(k) & k = 256, \ldots, 319 - N_{1p} \\ G_{lp}(k - 320 - N_{1p})U'_{HB2}(k) & k = 320 - N_{1p}, \ldots, 319 \end{cases}$$

The definition of $G_{hp}(k)$, k=0, . . . , 55, is given, for example, in table 1 below.

TABLE 2

| K | $g_{hp}(k)$ |
|---|---|
| 0 | 0.001622428 |
| 1 | 0.004717458 |
| 2 | 0.008410494 |
| 3 | 0.012747280 |
| 4 | 0.017772424 |
| 5 | 0.023528982 |
| 6 | 0.030058032 |
| 7 | 0.037398264 |
| 8 | 0.045585564 |
| 9 | 0.054652620 |
| 10 | 0.064628539 |
| 11 | 0.075538482 |
| 12 | 0.087403328 |
| 13 | 0.100239356 |
| 14 | 0.114057967 |
| 15 | 0.128865425 |
| 16 | 0.144662643 |
| 17 | 0.161445005 |
| 18 | 0.179202219 |
| 19 | 0.197918220 |
| 20 | 0.217571104 |
| 21 | 0.238133114 |
| 22 | 0.259570657 |
| 23 | 0.281844373 |
| 24 | 0.304909235 |
| 25 | 0.328714699 |
| 26 | 0.353204886 |
| 27 | 0.378318805 |
| 28 | 0.403990611 |
| 29 | 0.430149896 |
| 30 | 0.456722014 |
| 31 | 0.483628433 |
| 32 | 0.510787115 |
| 33 | 0.538112915 |
| 34 | 0.565518011 |
| 35 | 0.592912340 |
| 36 | 0.620204057 |
| 37 | 0.647300005 |
| 38 | 0.674106188 |
| 39 | 0.700528260 |
| 40 | 0.726472003 |
| 41 | 0.751843820 |

TABLE 2-continued

| K | $g_{hp}(k)$ |
|---|---|
| 42 | 0.776551214 |
| 43 | 0.800503267 |
| 44 | 0.823611104 |
| 45 | 0.845788355 |
| 46 | 0.866951597 |
| 47 | 0.887020781 |
| 48 | 0.905919644 |
| 49 | 0.923576092 |
| 50 | 0.939922577 |
| 51 | 0.954896429 |
| 52 | 0.968440179 |
| 53 | 0.980501849 |
| 54 | 0.991035206 |
| 55 | 1.000000000 |

It will be noted that, in variants of the invention, the values of $G_{hp}(k)$ will be able to be modified while keeping a progressive attenuation. Similarly, the low-pass filtering with variable bandwidth, $G_{lp}(k)$, will be able to be adjusted with values or a frequency medium that are different, without changing the principle of this filtering step.

It will also be noted that the bandpass filtering will be able to be adapted by defining a single filtering step combining the high-pass and low-pass filtering.

In another embodiment, the bandpass filtering will be able to be performed in an equivalent manner in the time domain (as in the block 112 of FIG. 1) with different filter coefficients according to the bit rate, after an inverse DCT step. However, it will be noted that it is advantageous to perform this step directly in the frequency domain because the filtering is performed in the domain of the LPC excitation and therefore the problems of circular convolution and of edge effects are very limited in this domain.

It will also be noted that, in the case of the 23.85 kbit/s bit rate, the de-emphasis of the excitation $U_{HB2}(k)$ is not performed to remain in agreement with the way in which the correction gain is computed in the AMR-WB coder and to avoid double multiplications. In this case, block 704 performs only the low-pass filtering.

The inverse transform block 705 performs an inverse DCT on 320 samples to find the high-frequency excitation sampled at 16 kHz. Its implementation is identical to the block 700, because the DCT-IV is orthonormal, except that the length of the transform is 320 instead of 256, and the following is obtained:

$$u_{HB0}(n) = \sum_{k=0}^{N_{16k}-1} U_{HB3}(k)\cos\left(\frac{\pi}{N_{16k}}\left(k+\frac{1}{2}\right)\left(n+\frac{1}{2}\right)\right)$$

in which $N_{16k}$=320 and k=0, . . . , 319.

This excitation sampled at 16 kHz is then, optionally, scaled by gains defined per subframe of 80 samples (block 707). In a preferred embodiment, a gain $g_{HB1}(m)$ is first computed (block 706) per subframe by energy ratios of the subframes such that, in each subframe of index m=0, 1, 2 or 3 of the current frame:

$$g_{HB1}(m) = \sqrt{\frac{e_3(m)}{e_2(m)}}$$

in which $$e_1(m) = \sum_{n=0}^{63} u(n+64m)^2 + \varepsilon$$

$$e_2(m) = \sum_{n=0}^{79} u_{HB0}(n+80m)^2 + \varepsilon$$

$$e_3(m) = e_1(m)\frac{\sum_{n=0}^{319} u_{HB0}(n)^2 + \varepsilon}{\sum_{n=0}^{255} u(n)^2 + \varepsilon}$$

with ε=0.01. The gain per subframe $g_{HB1}(m)$ can be written in the form:

$$g_{HB1}(m) = \sqrt{\frac{\frac{\sum_{n=0}^{63} u(n+64m)^2 + \varepsilon}{\sum_{n=0}^{255} u(n)^2 + \varepsilon}}{\frac{\sum_{n=0}^{79} u_{HB0}(n+80m)^2 + \varepsilon}{\sum_{n=0}^{319} u_{HB0}(n)^2 + \varepsilon}}}$$

which shows that, in the signal $u_{HB}$, the same ratio between energy per subframe and energy per frame as in the signal u(n) is assured.

The block 707 performs the scaling of the combined signal according to the following equation:

$$u_{HB}(n)=g_{HB1}(m)u_{HB0}(n),\ n=80m, \ldots ,80(m+1)-1$$

It will be noted that the implementation of the block 706 differs from that of the block 101 of FIG. 1, because the energy at the current frame level is taken into account in addition to that of the subframe. This makes it possible to have the ratio of the energy of each subframe in relation to the energy of the frame. The energy ratios (or relative energies) are therefore compared rather than the absolute energies between low band and high band.

Thus, this scaling step makes it possible to retain, in the high band, the energy ratio between the subframe and the frame in the same way as in the low band.

It will be noted here that, in the case of the 23.85 kbit/s bit rate, the gains $g_{HB1}(m)$ are computed but applied in the next step, as explained with reference to FIG. 4, to avoid the double multiplications. In this case $u_{HB}(n)=u_{HB0}(n)$.

According to the invention, the block 708 then performs a scale factor computation per subframe of the signal (steps E602 to E603 of FIG. 6), as described previously with reference to FIG. 6 and detailed in FIGS. 4 and 5.

Finally, the corrected excitation $u_{HB}'(n)$ is filtered by the filtering module 710 which can be performed here by taking as transfer function $1/\hat{A}(z/\gamma)$, in which γ=0.9 at 6.6 kbit/s and γ=0.6 at the other bit rates, which limits the order of the filter to the order 16.

In a variant, this filtering will be able to be performed in the same way as is described for the block 111 of FIG. 1 of the AMR-WB decoder, but the order of the filter changes to 20 at the 6.6 bit rate, which does not significantly change the quality of the synthesized signal. In another variant, it will be possible to perform the LPC synthesis filtering in the frequency domain, after having computed the frequency response of the filter implemented in the block 710.

In a variant embodiment, the step of filtering by a linear prediction filter 710 for the second frequency band is combined with the application of the optimized scale factor, which makes it possible to reduce the processing complexity. Thus, the steps of filtering $1/\hat{A}(z/\gamma)$ and of application of the optimized scale factor $g_{HB2}$ are combined in a single step of filtering $g_{HB2}/\hat{A}(z/\gamma)$ to reduce the processing complexity.

In variant embodiments of the invention, the coding of the low band (0-6.4 kHz) will be able to be replaced by a CELP coder other than that used in AMR-WB, such as, for example, the CELP coder in G.718 at 8 kbit/s. With no loss of generality, other wide-band coders or coders operating at frequencies above 16 kHz, in which the coding of the low band operates with an internal frequency at 12.8 kHz, could be used. Moreover, the invention can obviously be adapted to sampling frequencies other than 12.8 kHz, when a low-frequency coder operates with a sampling frequency lower than that of the original or reconstructed signal. When the low-band decoding does not use linear prediction, there is no excitation signal to be extended, in which case it will be possible to perform an LPC analysis of the signal reconstructed in the current frame and an LPC excitation will be computed so as to be able to apply the invention.

Finally, in another variant of the invention, the excitation (u(n)) is resampled, for example by linear interpolation or cubic "spline", from 12.8 to 16 kHz before transformation (for example DCT-IV) of length 320. This variant has the defect of being more complex, because the transform (DCT-IV) of the excitation is then computed over a greater length and the resampling is not performed in the transform domain.

Furthermore, in variants of the invention, all the computations necessary for the estimation of the gains ($G_{HBN}$, $g_{HB1}(m)$, $g_{HB2}(m)$, $g_{HBN}$, . . . ) will be able to be performed in a logarithmic domain.

In variants of the band extension, the excitation in low band u(n) and the LPC filter $1/\hat{A}(z)$ will be estimated per frame, by LPC analysis of a low-band signal for which the band has to be extended. The low-band excitation signal is then extracted by analysis of the audio signal.

In a possible embodiment of this variant, the low-band audio signal is resampled before the step of extracting the excitation, so that the excitation extracted from the audio signal (by linear prediction) is already resampled.

The band extension illustrated in FIG. 7 is applied in this case to a low band which is not decoded but analyzed.

Figure 8:
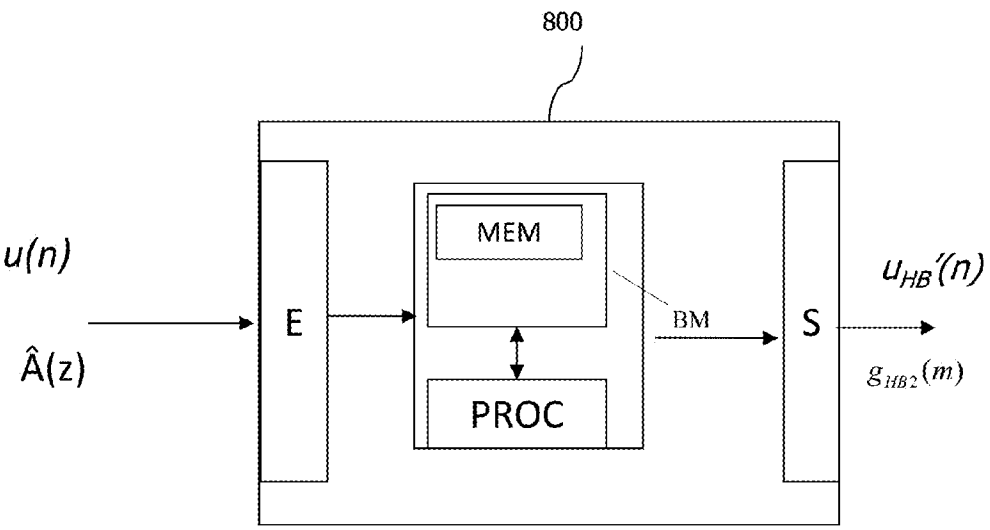
FIG. 8 illustrates a hardware implementation of an optimized scale factor determination device in a band extension according to the invention.

FIG. 8 represents an exemplary physical embodiment of a device for determining an optimized scale factor 800 according to the invention. The latter can form an integral part of an audio frequency signal decoder or of an equipment item receiving audio frequency signals, decoded or not.

This type of device comprises a processor PROC cooperating with a memory block BM comprising a storage and/or working memory MEM.

Such a device comprises an input module E suitable for receiving an excitation audio signal decoded or extracted in a first frequency band called low band (u(n) or U(k)) and the parameters of a linear prediction synthesis filter ($\hat{A}(z)$). It comprises an output module S suitable for transmitting the synthesized and optimized high-frequency signal ($u_{HB}'(n)$) for example to a filtering module like the block 710 of FIG. 7 or to a resampling module like the module 311 of FIG. 3.

The memory block can advantageously comprise a computer program comprising code instructions for implementing the steps of the method for determining an optimized scale factor to be applied to an excitation signal or to a filter within the meaning of the invention, when these instructions are executed by the processor PROC, and notably the steps of determination (E602) of a linear prediction filter, called additional filter, of lower order than the linear prediction filter of the first frequency band, the coefficients of the additional filter being obtained from parameters decoded or extracted from the first frequency band, and of computation (E603) of an optimized scale factor as a function at least of the coefficients of the additional filter.

Figure 6:
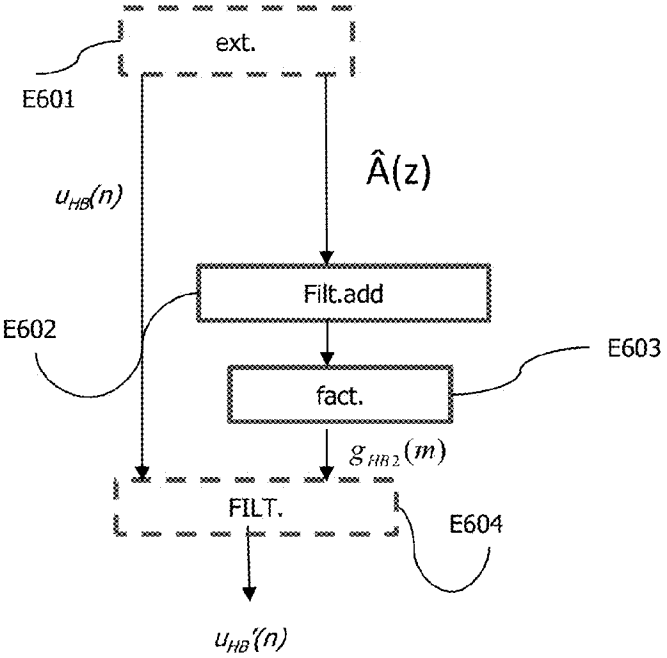
FIG. 6 illustrates, in flow diagram form, the main steps of a method for determining an optimized scale factor according to an embodiment of the invention.

Typically, the description of FIG. 6 reprises the steps of an algorithm of such a computer program. The computer program can also be stored on a memory medium that can be read by a reader of the device or that can be downloaded into the memory space thereof.

The memory MEM stores, generally, all the data necessary for the implementation of the method.

In a possible embodiment, the device thus described can also comprise functions for application of the optimized scale factor to the extended excitation signal, of frequency band extension, of low-band decoding and other processing functions described for example in FIGS. 3 and 4 in addition to the optimized scale factor determination functions according to the invention.

The invention claimed is:

1. A method of operating an apparatus for extending a frequency band of an audio-frequency signal, the method comprising acts of:

in an apparatus for extending a frequency band of an audio-frequency signal that is not a transitory propagating wave, by determining an optimized scale factor to be applied to an excitation signal or to a filter, computing of a frequency response, R, of a linear prediction filter of a frequency band, smoothing of the value of R, using a smoothing circuit configured to select between smoothing methods and to use the selected method to obtain $R_{smoothed}$, the smoothing method being selected, from a group of smoothing methods comprising at least two smoothing methods, in function of a set of parameters comprising a plurality of parameters including the value of spectral slope or tilt, determining the optimized scale factor, using a determining circuit, by determining the optimized scale factor comprising the computation of:

$$\max(\min(R_{smoothed}, Q), P)/P,$$

where P is the frequency response of linear prediction filter over a second frequency band, the second frequency band being higher than the first frequency band, Q is the frequency response of an additional filter obtained by truncating the linear prediction filter polynomial, applying the optimized scale factor in a modification circuit to modify an excitation signal or a filter, extending the frequency band of the audio-frequency signal using an extending circuit, using an extending circuit, for applying the excitation signal or the filter to the audio-frequency signal.

2. The method of claim 1, wherein the set of smoothing methods comprises an exponential smoothing with a factor being fixed over time.

3. The method of claim 2, wherein the exponential smoothing is of the type:

$$R_{smoothed}=0.5R_{precomputed}+0.5R_{prev},$$

where $R_{prev}$ corresponds to the value of $R_{smoothed}$ in the previous subframe, $R_{precomputed}$ corresponds to the value of R as computed during the step of computing of a frequency response, R, of a linear prediction filter of a frequency band.

4. The method of claim 1, wherein the set of smoothing methods comprises a smoothing method being adaptive over time the smoothing circuit configured to select between the adaptive smoothing method and other smoothing methods.

5. The method of claim 4, wherein the smoothing is stronger for smaller values of R.

6. The method of claim 4, wherein the adaptive smoothing is of the form:

$$R_{smoothed}=(1-\alpha)R_{precomputed}+\alpha\cdot R_{prev},$$

where $\alpha=1-R_{precomputed}\hat{}2$, where $R_{prev}$ corresponds to the value of $R_{smoothed}$ in the previous subframe, $R_{precomputed}$ corresponds to the value of R as computed during the step of computing of a frequency response, R, of a linear prediction filter of a frequency band.

7. The method of claim 3, wherein $$R_{precomputed}=\frac{1}{\left|\sum_{i=0}^{M}\hat{a}_i e^{-ji\theta}\right|}$$

where M=16 is the order of the linear prediction filter, θ corresponds to the frequency of 6,000 Hz normalized for a sampling rate of 12.8 kHz, coefficients $\hat{a}_i$ being the coefficients of the linear prediction filter polynomial.

8. An apparatus for extending a frequency band of an audio-frequency signal that is not a transitory propagating wave, by determining an optimized scale factor to be applied to an excitation signal or to a filter, the apparatus comprising:

a processor circuit for computing a frequency response, R, of a linear prediction filter over a first frequency band, of an audio-frequency signal that is not a transitory propagating wave, a smoothing circuit configured to select between smoothing methods and to use the selected method to smooth the value of R to obtain $R_{smoothed}$, wherein the smoothing method is selected among a group of at least two smoothing methods based on a set of a plurality of parameters including the value of the spectral slope or tilt, of the audio-frequency signal, the apparatus being configured for determining the optimized scale factor, using the computation of:

$$\max(\min(R_{smoothed},Q),P)/P,$$

where P is the frequency response of linear prediction filter over a second frequency band, the second frequency band being higher than the first frequency band, Q is the frequency response of an additional filter obtained by truncating the linear prediction filter polynomial a modification circuit configured to apply the optimized scale factor to modify an excitation signal or a filter, an extending circuit configured to extend the frequency band of the audio-frequency signal by applying the excitation signal or the filter to the audio-frequency signal.

9. The apparatus of claim 8, wherein the set of smoothing methods comprises an exponential smoothing with a factor being fixed over time.

10. The apparatus of claim 9, wherein the exponential smoothing is of the type:

$$R_{smoothed}=0.5R_{precomputed}+0.5R_{prev},$$

where $R_{prev}$ corresponds to the value of $R_{smoothed}$ in the previous subframe, $R_{precomputed}$ corresponds to the value of R as computed during the step of computing of a frequency response, R, of a linear prediction filter of a frequency band.

11. The apparatus of claim 8, wherein the set of smoothing methods comprise a smoothing method being adaptive over time, the smoothing circuit configured to select between the adaptive smoothing method and other smoothing methods.

12. The apparatus of claim 11, wherein the smoothing is stronger for smaller values of R.

13. The apparatus of claim 11, wherein the adaptive smoothing is of the form:

$$R_{smoothed}=(1-\alpha)R_{precomputed}+\alpha\cdot R_{prev},$$

where $\alpha=1-R_{precomputed}\hat{}2$, where $R_{prev}$ corresponds to the value of $R_{smoothed}$ in the previous subframe, $R_{precomputed}$ corresponds to the value of R as computed during the step of computing of a frequency response, R, of a linear prediction filter of a frequency band.

14. The apparatus of claim 10, wherein $$R_{precomputed}=\frac{1}{\left|\sum_{i=0}^{M}\hat{a}_i e^{-ji\theta}\right|},$$

and wherein M=16 is the order of the linear prediction filter, θ corresponds to the frequency of 6,000 Hz normalized for a sampling rate of 12.8 kHz, coefficients $\hat{a}_i$ being the coefficients of the linear prediction filter polynomial.

* * * * *